US008523794B2

(12) United States Patent
Iker et al.

(10) Patent No.: US 8,523,794 B2
(45) Date of Patent: Sep. 3, 2013

(54) METHOD AND APPARATUS FOR TREATING LYMPHEDEMA

(75) Inventors: Emily Iker, Pacific Palisades, CA (US); Rajinder S. Gill, Pico Rivera, CA (US)

(73) Assignee: Milka LLC, Santa Monica, CA (US)

( * ) Notice: Subject to any disclaimer, the term of this patent is extended or adjusted under 35 U.S.C. 154(b) by 260 days.

(21) Appl. No.: 12/924,002

(22) Filed: Sep. 16, 2010

(65) Prior Publication Data

US 2011/0082401 A1 Apr. 7, 2011

Related U.S. Application Data

(60) Provisional application No. 61/276,899, filed on Sep. 17, 2009.

(51) Int. Cl.
*A61H 9/00* (2006.01)

(52) U.S. Cl.
USPC ..... 601/152; 601/148; 601/149; 601/150; 601/151

(58) Field of Classification Search
USPC ..... 602/13; 601/148–152; 600/481, 600/483, 547
See application file for complete search history.

(56) References Cited

U.S. PATENT DOCUMENTS

| | | | | |
|---|---|---|---|---|
| 4,865,020 | A * | 9/1989 | Bullard | 601/152 |
| 4,941,458 | A * | 7/1990 | Taheri | 601/152 |
| 5,022,387 | A * | 6/1991 | Hasty | 601/152 |
| 5,117,812 | A * | 6/1992 | McWhorter | 601/149 |
| 5,817,138 | A * | 10/1998 | Suzuki | 607/67 |
| 5,968,073 | A * | 10/1999 | Jacobs | 606/202 |
| 6,080,120 | A * | 6/2000 | Sandman et al. | 601/152 |
| 6,179,796 | B1 | 1/2001 | Waldridge | |
| 6,315,745 | B1 | 11/2001 | Kloecker | |
| 6,436,064 | B1 | 8/2002 | Kloecker | |
| 6,558,338 | B1 * | 5/2003 | Wasserman | 601/152 |
| 6,645,165 | B2 | 11/2003 | Waldridge et al. | |
| 6,852,089 | B2 | 2/2005 | Kloecker et al. | |
| 6,966,884 | B2 | 11/2005 | Waldridge et al. | |
| 7,849,114 | B2 * | 12/2010 | Boss et al. | 707/831 |
| 2001/0018563 | A1 * | 8/2001 | Waldridge et al. | 601/152 |
| 2005/0222526 | A1 * | 10/2005 | Perry et al. | 601/151 |
| 2006/0036203 | A1 * | 2/2006 | Ouchene et al. | 601/151 |
| 2006/0161081 | A1 * | 7/2006 | Barak et al. | 601/151 |
| 2008/0097264 | A1 * | 4/2008 | Webster et al. | 601/152 |
| 2008/0103397 | A1 * | 5/2008 | Barak | 600/492 |
| 2010/0036299 | A1 * | 2/2010 | Gough | 601/152 |

* cited by examiner

OTHER PUBLICATIONS

Hegarty, M. Design of an Intelligent Compression Stocking for Reducing Ulcer Healing Time. [Online]. Feb. 20, 2008. [retrieved on Sep. 25, 2012]. Retrieved from the Internet: <URL:http://www.crim.ncsu.edu/category/publication-type/ms-thesis>.*

*Primary Examiner* — Justine Yu
*Assistant Examiner* — Timothy Stanis
(74) *Attorney, Agent, or Firm* — Malcolm Romano

(57) ABSTRACT

An apparatus and method for treatment of patients suffering from lymphedema. The apparatus includes a multiple chamber sleeve positioned in a wrap around fashion on a body extremity to be treated. The chambers are sequentially inflated and maintained so until all chambers are inflated and then all the chambers are simultaneously deflated except the proximal end chamber to move edema fluids out of the afflicted area. The apparatus includes the capability of applying interferential therapy either alone or in combination with compression therapy. Advantageously, the sleeve chambers capture pressurized air when applied thereto, at designated locations, so as to form air pockets that can selectively apply isolated points of pressure, and in combination with the application of electrical current to a patient's affected area, provide effective lymphedema therapy without disrupting normal vascular and lymphatic functioning.

20 Claims, 22 Drawing Sheets

METHOD AND APPARATUS FOR TREATING LYMPHEDEMA

CROSS REFERENCE TO RELATED APPLICATION

This utility application claims the benefit under Title 35 United States Code §119(e) of U.S. Provisional Patent Application No. 61/276,899, which was filed on Sep. 17, 2009, and which is hereby incorporated by reference.

FIELD OF THE INVENTION

The present disclosure relates generally to a method and apparatus for treating patients afflicted with Lymphedema. More particularly, it relates to a multiple chamber sleeve to be positioned on a body extremity to be treated wherein the chambers are sequentially inflated and maintained so until all chambers are inflated and then all the chambers are simultaneously deflated to move edema fluids and stimulate the lymphatic system.

BACKGROUND OF THE INVENTION

Lymphedema, also known as "Lymphoedema" or "lymphatic obstruction", is an accumulation of lymphatic fluid in the interstitial tissue that causes swelling, most often in the arm(s) and/or leg(s) and occasionally in other parts of the body due to compromised lymphatic system. The lymphatic system collects and filters the interstitial fluid of the body. Primary Lymphedema can develop when lymphatic vessels are missing or impaired. It may be present at birth, develop at the onset of puberty (praecox), or not become apparent for many years into adulthood (tarda). Secondary Lymphedema occurs when lymph vessels are damaged or lymph nodes removed during surgery and/or radiation therapy for cancer treatment. Lymphedema affects both men and women. In women, it is most prevalent in the upper limbs after breast cancer surgery and lymph node dissection, occurring in the arm on the side of the body in which the surgery is performed. It may also occur in the lower limbs or groin after surgery for colon, ovarian or uterine cancer in which removal of lymph nodes is desirable. In men, lower-limb Primary Lymphedema is most common, occurring in one or both legs. Surgery and/or treatment for prostate, colon and testicular cancers may result in Secondary Lymphedema, particularly where lymph nodes have been removed or damaged.

Lymphedema may also be associated with accidents or certain disease or problems that may inhibit the lymphatic system from functioning properly. In tropical areas, a common cause of Secondary Lymphedema is filariasis, a parasitic infection. Some cases of lower-limb lymphedema have been associated with the use of Tamoxifen, due to the blood clots and deep vein thrombosis (DVT) that can be caused by this medication. Lymphedema differs from edema resulting from venous insufficiency, which is not lymph-edema. However, untreated venous insufficiency can progress into a combined venous/lymphatic disorder which is treated in the same way as lymphedema.

Lymphedema carries the constant risk of developing an uncontrolled infection in the affected limb(s). When the impairment becomes so great that the lymphatic fluid exceeds the lymphatic transport capacity, an abnormal amount of protein-rich fluid collects in the tissues of the affected area. Left untreated, this stagnant, protein-rich fluid not only causes tissue channels to increase in size and number, but also reduces oxygen availability in the transport system, interferes with wound healing, and provides a culture medium for bacteria that can result in lymphangitis (infection). Symptoms may include severe fatigue, a heavy swollen limb or localized fluid accumulation in other body areas, deformity ("elephantiasis"), discoloration of the skin overlying the lymphedema, recurrent episodes of cellulitis, and in severe cases, skin ulcers and infections. In certain exceptionally-severe cases, prolonged, untreated lymphedema can lead to a form of cancer known as Lymphangiosarcoma. Because the lymphatic fluids are basically stagnant, toxins and pathogens can build up after an injury and overwhelm the local defense system without completely activating an immune response. Lymphedema may also result in psychological distress. The normal, daily-living lifestyle can become severely limited. A treatment for lymphedema is called Complete Decongestive Therapy which may include manual lymphatic drainage, compression therapy, short stretch compression bandaging, therapeutic exercise, and skin care.

DESCRIPTION OF RELATED ART

Manual massage coupled with compression therapy (CT) and/or Interferential therapy (IFT) has been shown to be highly effective in lymphedema treatment. In compression therapy, an elastic sleeve is wrapped around the affected limb and compression to the limb is applied by pneumatically inflating/deflating the sleeve with a pump. Various device combinations configured as a sleeve and pump (called compression pump—CP), currently exist in the marketplace for use in compression therapy. A schematic representation of one such sleeve is shown in FIG. 1. The sleeve is divided into multiple chambers (segments). These chambers are inflated/deflated to move the lymphatic fluid from the extremity (hand or foot) of the limb (arm or leg) towards the torso. Some sleeves create uniform pressure in a chamber while others create pressure points depending upon their individual construction. A block diagram of a currently available pump is shown in FIG. 2*a*. When power is applied, an air pump is actuated to provide pressurized air. The pressurized air from the pump goes through a mechanical pressure regulator, which is set to regulate and adjust the pressure of the air to a value that is desired in the sleeve. The regulated pressurized air is directed through a multi-port mechanical valve. An electric motor rotates the mechanical valve and sequentially directs the pressurized air though each port of the valve for a set period of time. Each port of the valve is connected to a tube that directs the air to each chamber of the sleeve. The number of ports in the mechanical valve and thus the number of tubes are same as the number of chambers in a sleeve. The pressure in a chamber is directly proportional to the pressure set by the regulator and the time the valve is opened into a given chamber. After all the connected chambers in a sleeve are inflated, the mechanical valve opens a port that deflates all the connected chambers in a sleeve simultaneously. Then the inflation cycle begins again.

Another existing device in the marketplace is shown in the block diagram of FIG. 2*b*. In this device, an electronic controller controls an electric motor that rotates a multiport mechanical valve. In this device, a mechanical pressure regulator is eliminated and an electronic pressure sensor monitors the pressure of the air provided by the pump. By adjusting the motor speed and/or the time a valve is kept open, a desired pressure in the chamber can be achieved. The pressure in the chambers is set by a rotary knob with a dial. Another rotary knob with a dial allows setting a time pause between inflation of the individual chambers. Yet still another existing device in the marketplace is shown in the block diagram of FIG. 2*c*. In this device, the electric motor—multiport mechanical rotary valve combination is replaced by a pair of valves—one for inflation and one for deflation for each chamber of the sleeve or a modification thereof. The knobs are replaced by a keypad while the dial is replaced by an LCD display. Examples of prior art methods and devices described above can be found, for example, in U.S. Pat. No. 6,436,064 to Kloecker, U.S. Pat. No. 6,852,089 to Kloecker, U.S. Pat. No. 6,966,884 to Waldridge, U.S. Pat. No. 6,179,796 to Waldridge, U.S. Pat. No. 6,645,165 to Waldridge and U.S. Pat. No. 6,315,745 to Kloecker.

An inspection of such patents reveals that they have a number of drawbacks and limitations. The inventors of the invention described herein have developed a unique inferential therapy (IFT) which uses multiple electrodes positioned in the sleeve which makes electrical contact with the body extremity when the sleeve is mounted on the extremity. These electrodes are attached to an electronic controller which allows a controlled pulsed faradic current corresponding to about 15-30 millivolts to pass through the limb (body extremity) for a certain period of time. The effect of IFT is to enhance the effectiveness of the lymphedema treatment provided by the compression therapy. Thus, IFT may be applied either alone or in combination with CT. The inventors have also developed a technique for the use of the biological impedance of the extremity under treatment as a measure of the effectiveness of the lymphedema treatment. The biological impedance of the extremity under treatment will change as lymphatic fluid is urged out of the extremity. None of the devices of the prior art offer integrated CT and IFT therapies and the monitoring and use of biological impedance as a treatment parameter. Moreover, regardless of the device(s) used, none of the existing devices have a provision to quantitatively assess the effectiveness of the therapy (CT and/or IFT) and adjustment of CT variables such as pressure in the sleeve chambers, a pause between inflation of adjacent chambers and termination of treatment upon attainment of a preset biological impedance and adjustment of IFT parameters such as pulse amplitude, pulse duration and pulse frequency, among others. The existing devices usually have controls that are used by the patient to set and/or modify the treatment parameters which may be dangerous since patients generally do not have the knowledge to set these parameters correctly. Incorrectly set parameters may either cause damage to the extremity under treatment or result in an ineffective treatment session. Usually no log is kept of the CT and/or IFT parameters, as well as the biological impedance, used in the therapy session and the corresponding quantitative improvement in lymphedema. Therefore, there is no way to determine if the treatment parameters were set correctly. Therefore, the inventors have developed a method and apparatus that overcomes the prior mentioned shortcomings. The apparatus described herein is compact, easy to use and offers greater flexibility and programmability according to the needs of the patient to aid in the successful treatment of lymphedema.

SUMMARY OF THE INVENTION

The present invention is directed to an improved method and apparatus for treating a body extremity of a patient, typically but not limited to an arm or leg, to relieve the swelling and discomfort due to lymphedema and other causes. The apparatus comprises a sleeve with a plurality of individually inflatable chambers sequentially arranged along the length of the sleeve between its proximal end and its distal end. A pneumatic pump supplies regulated pressurized air to inflate the chambers in the sleeve through independently controlled solenoid valves. Uniquely, each chamber is maintained inflated as pressurized air is supplied sequentially to the chambers until the last chamber is inflated. Subsequent to monitoring selected parameters such as biological impedance; the number of inflation cycle repetitions and the total elapsed time, and depending upon their respective value, either all the chambers, with the exception of the initial one, are deflated and the inflation cycle is repeated or the therapy session is terminated wherein all the chambers are deflated. A programmable electronic controller can turn the pump on and off and the valves to be open or closed in a prescribed fashion to execute a preset therapy protocol. Moreover, in those instances where the use of pressure gradients is the therapy of choice, the controller (processor) can command inflating the chambers to different pressures such as monotonically increasing or monotonically decreasing and variations thereof, along the length of the sleeve. In sum, the apparatus is thus capable of performing the following functions: (1) adjustable/automatic gradient sequential compression therapy (CT); (2) interferential therapy (IFT); (3) quantitative assessment of the impact of CT & IFT on the lymphedema condition; (4) evaluating biological impedance and (5) recording/logging the CT and IFT parameters and their correlation to the quantitative change in the lymphedema condition. The apparatus is small and versatile enough to be incorporated into chairs for home or office use and for the airline industry and hospitals.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION OF THE PREFERRED EMBODIMENT

Various embodiments are described more fully below with reference to the accompanying drawings, which form a part hereof, and which show specific example embodiments for practicing various embodiments. However, other embodiments may be implemented in many different forms and should not be construed as limited to the embodiments set forth herein; rather, these embodiments are provided so that this disclosure will be thorough and complete.

Figure 1:
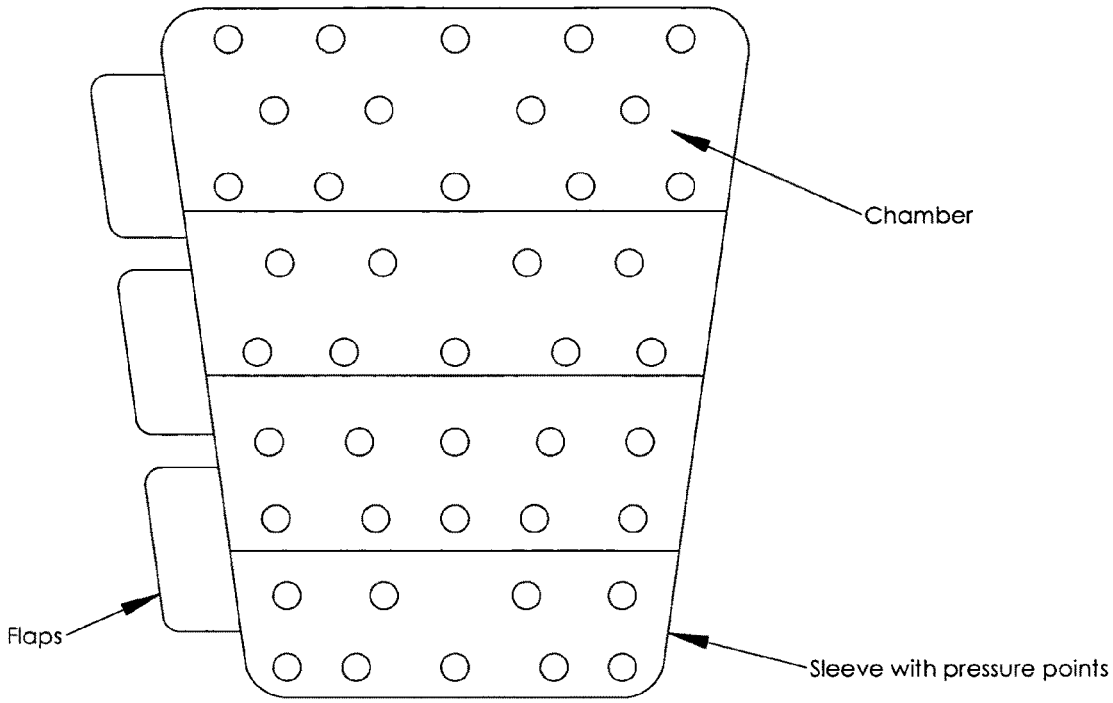
FIG. 1 PRIOR ART
FIG. 1 is a schematic drawing of a sleeve of the prior art.
Figure 2A:
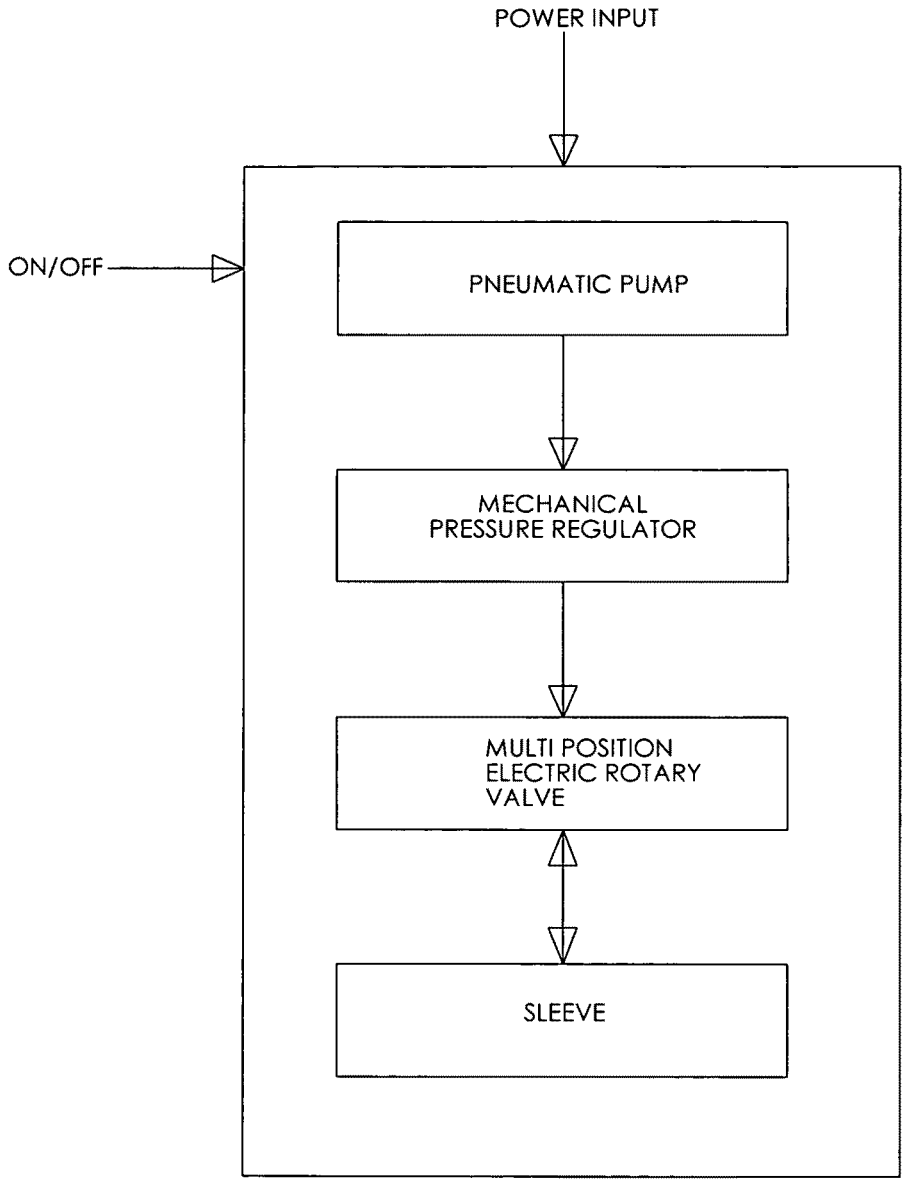
FIG. 2a PRIOR ART
FIGS. 2(*a-c*) are block diagrams of lymphedema treatment apparatus of the prior art.
Figure 2B:
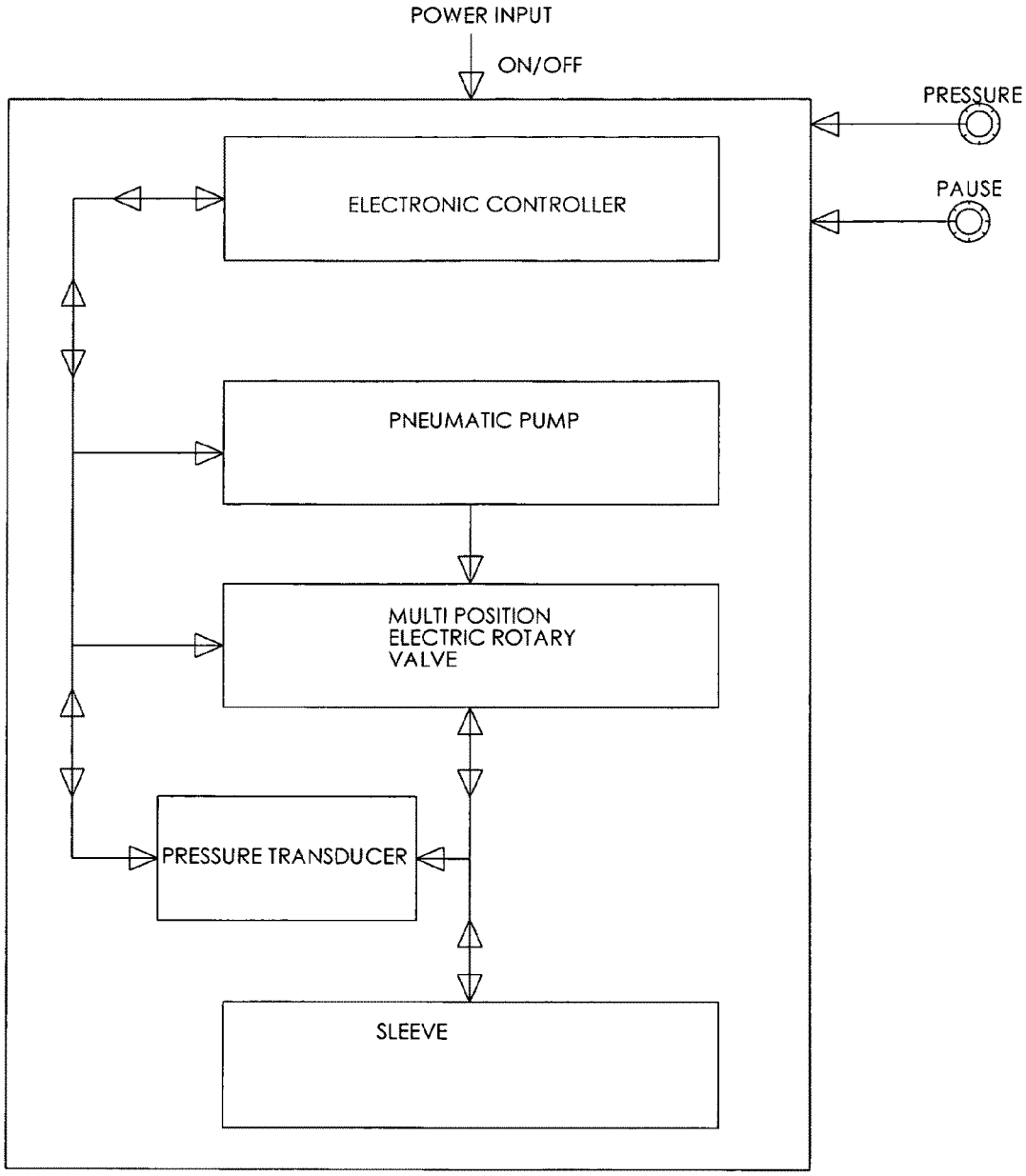
FIG. 2b PRIOR ART
Figure 2C:
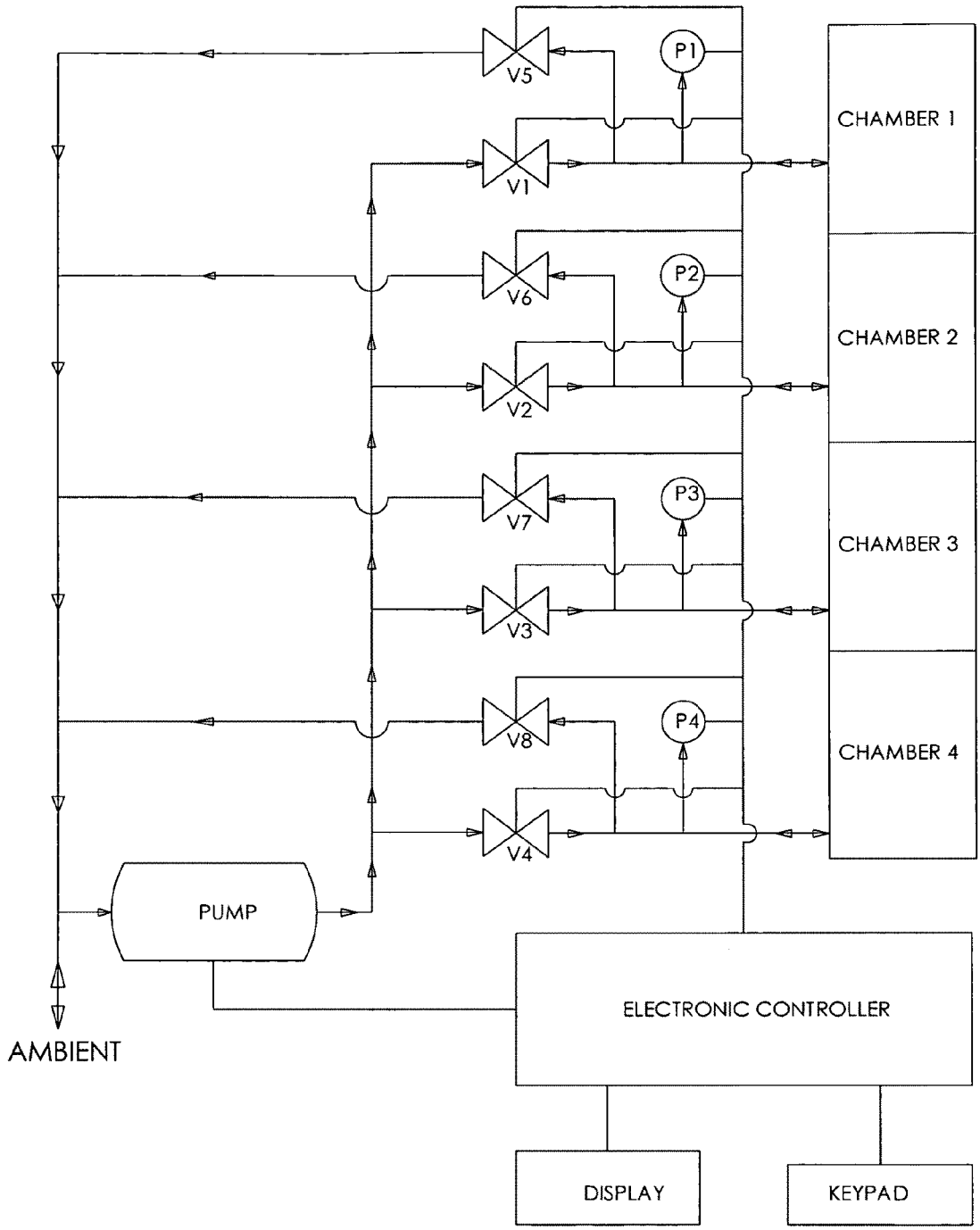
Figure 2c PRIOR ART
Figure 3A:
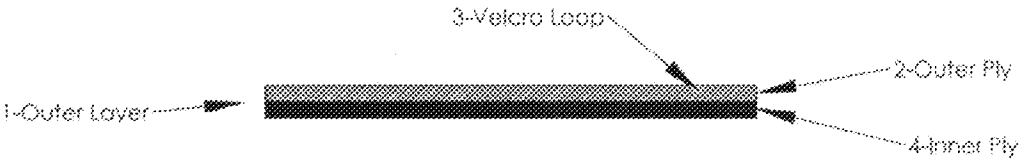
FIG. 3*a* is a cross-sectional view of an elastic material used for the multi-chamber compression sleeve of the present invention.
Figure 3B:
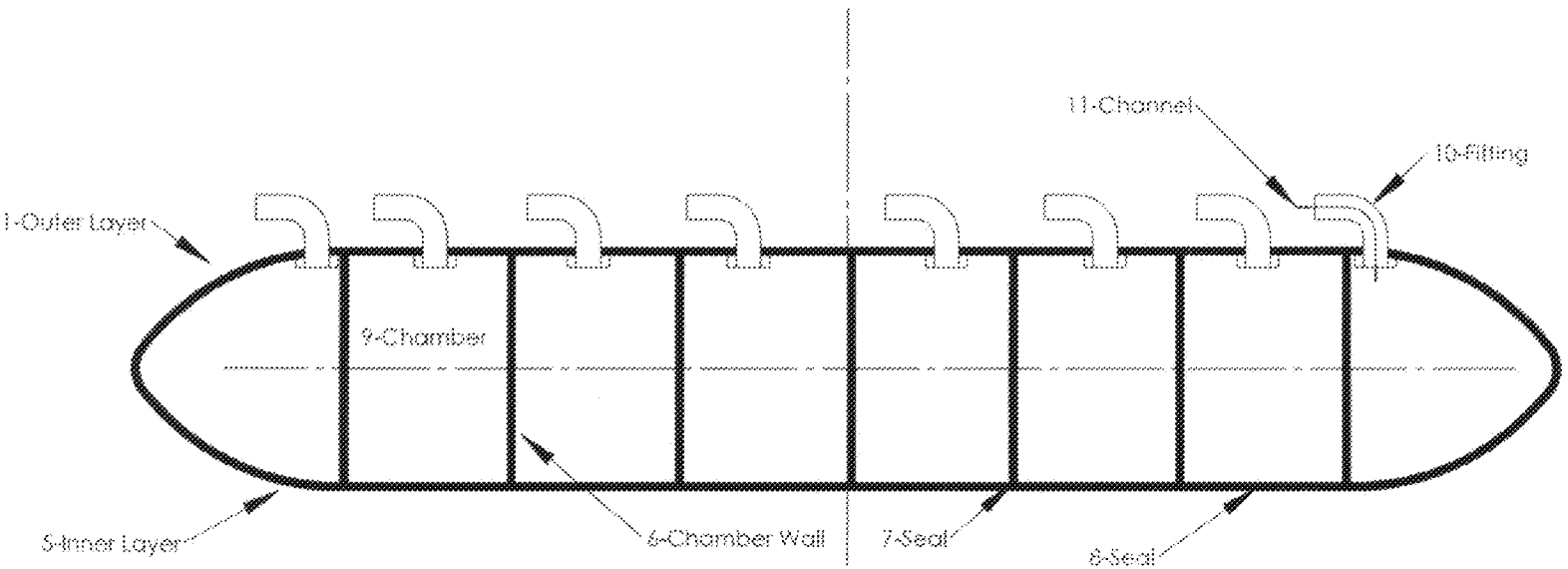
FIG. 3*b* is a cross-sectional view of an embodiment of the multi-chamber compression sleeve of the present invention.
Figure 3C:
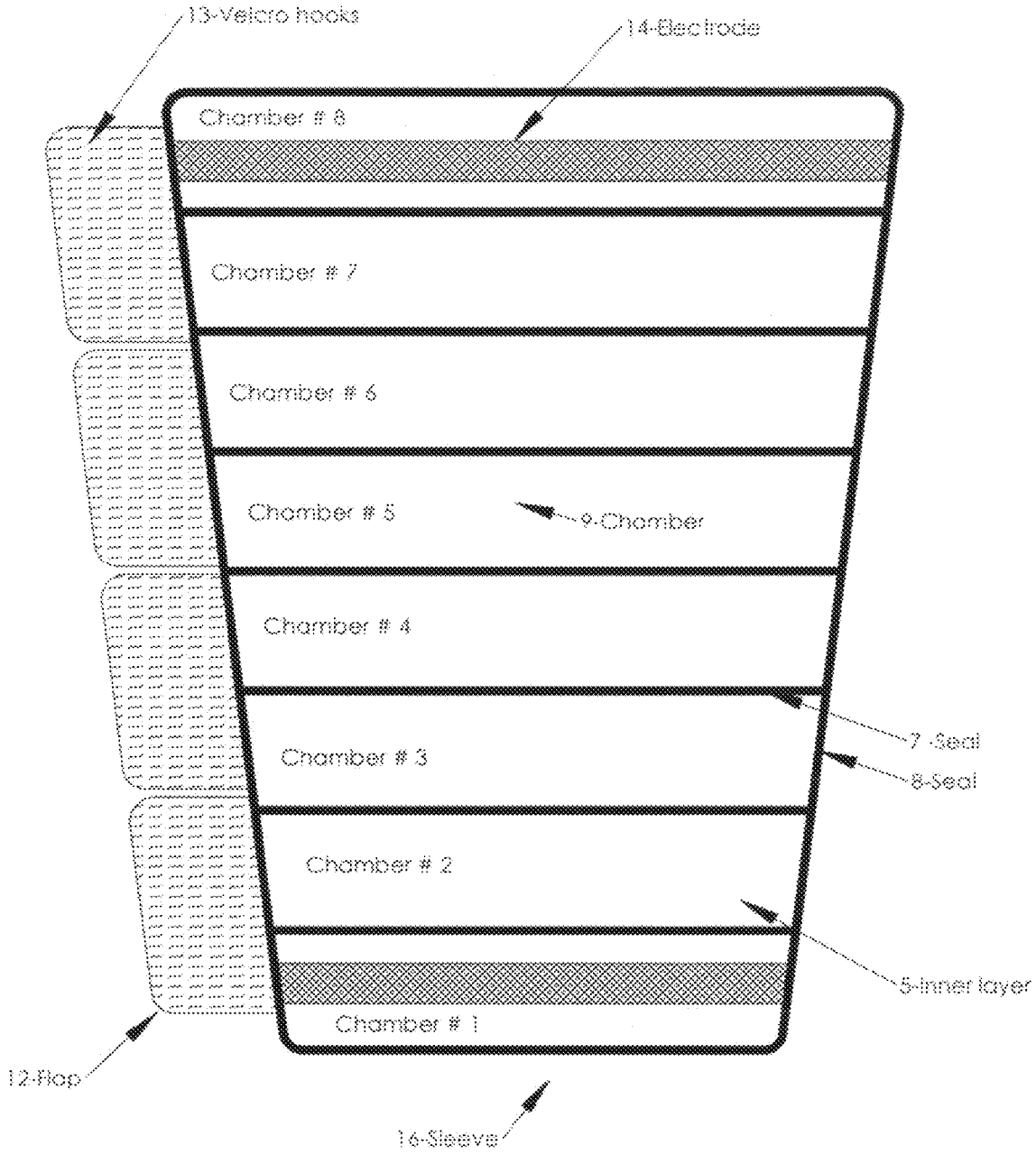
FIG. 3*c* is a front schematic view of the compression sleeve of FIG. 3*b;*
Figure 3D:
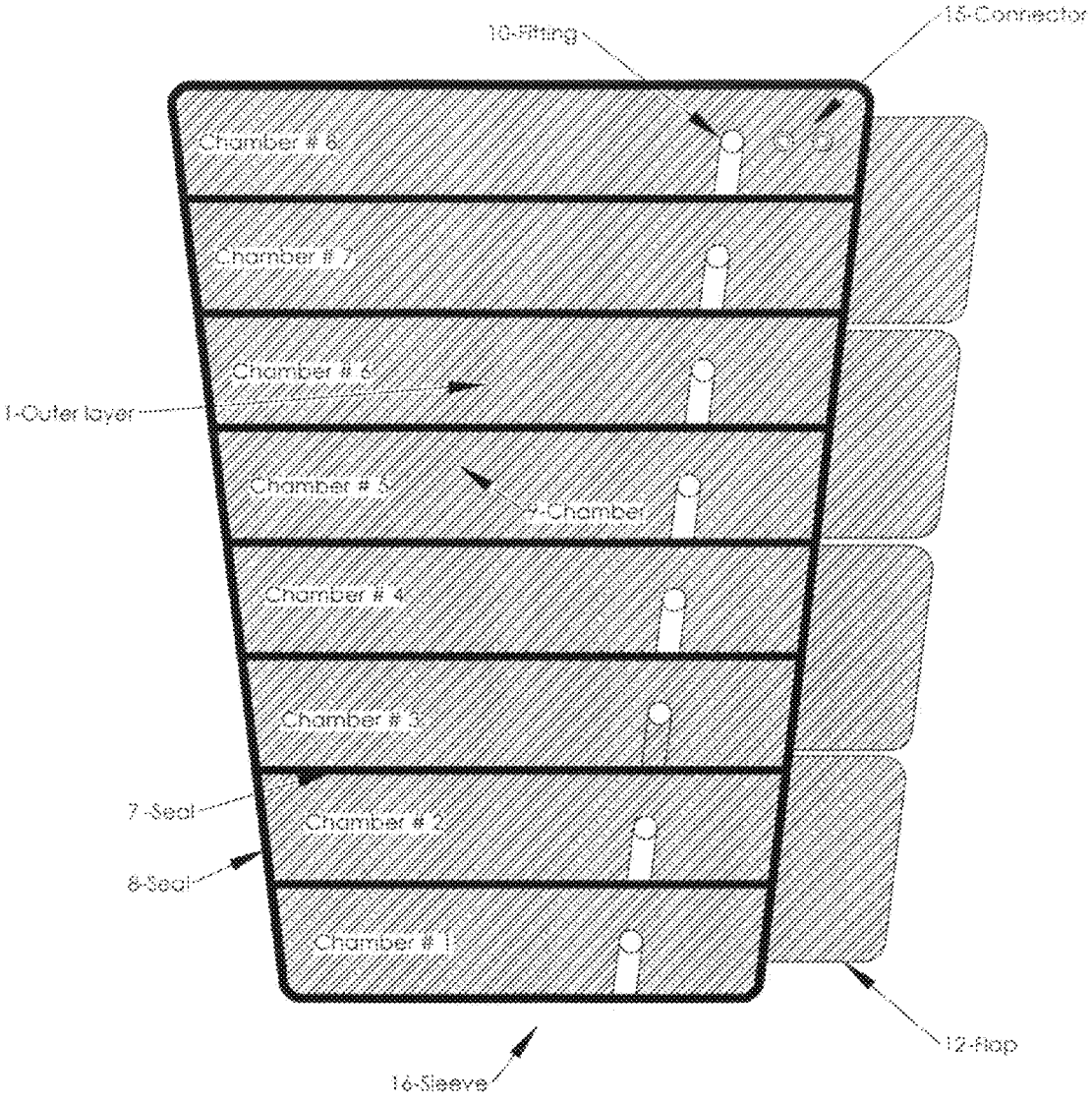
FIG. 3*d* is a rear schematic view of the compression sleeve of FIG. 3*b;*

Referring now to FIGS. 3*a*-3*c* there is shown an example embodiment of a sleeve 16 adapted and configured for use on an arm of a patient. It is to be understood that although the description refers to an arm, the concepts and inventive attributes of the invention also apply for other body extremities, such as a patient's leg, except that the "sleeve" would be configured in shape to accommodate the extremity of interest. The sleeve 16 is configured in a multi bladder or chamber arrangement and is formed of a material having an outer layer 1 preferably made of a two ply elastic material comprising an outer ply 2 preferably made of a woven urethane fabric embedded with loops 3 similar to those found in a Velcro type material and an inner ply 4 formed of an elastic and non-gas permeable urethane sheet. The outer ply 2 and inner ply 4 are laminated together while under exposure to heat and pressure. The sleeve 16 also includes an inner layer 5 which is made from an elastic non-gas permeable material such as urethane. The two layers are suitably cut so that they can wrap around the arm when in use. Elastic sheets 6 are positioned within the sleeve 16 to establish a plurality of sealed chambers 9. The sheets 6 are sealed from edge to edge (shown as 7) between the outer and inner layers to create multiple circumferential closed chambers. The two layers are sealed together at the sleeve periphery 8. This structure creates multiple chambers 9 in the sleeve that are hermetically sealed and can be independently inflated. A suitable fitting 10, such as barbed end, is also sealed to the outer layer of each chamber so that there is a passage or channel 11 to introduce air into the chamber. Flaps 12 are positioned at the edge of the sleeve 16 and Velcro sheets 13, with "hooks", are attached to the inner layer of the flaps. When the sleeve is positioned around the arm in a wraparound fashion, the Velcro hooks on the flaps engage the outer layer which has corresponding Velcro type loops for securing the sleeve 16 on the patients arm. The Velcro type anchoring capability permits one sleeve size to fit snugly around a multitude of different sized arms. The sleeve 16 may also be held in place by adjustable straps or a fastener such as a zipper disposed along the length of the sleeve. The inner layer 5 is configured to come in contact with the patient's skin when the sleeve 16 is wrapped around the arm and includes electrically conductive electrodes 14 for IFT and biological impedance analysis. The electrodes 14 may be created by silk screening electrically conductive ink (such as Ag or Au) on the surface of the inner layer 5 that comes in contact with the patient's skin or by attachment of an electrically conductive foil having an adhesive surface that will adhere to the inner layer. A suitable connector 15 in proximity to the flap edge is attached to the outer layer 1 of sleeve 16 to provide for making an electrical connection with the electrodes 14.

Figure 4A:
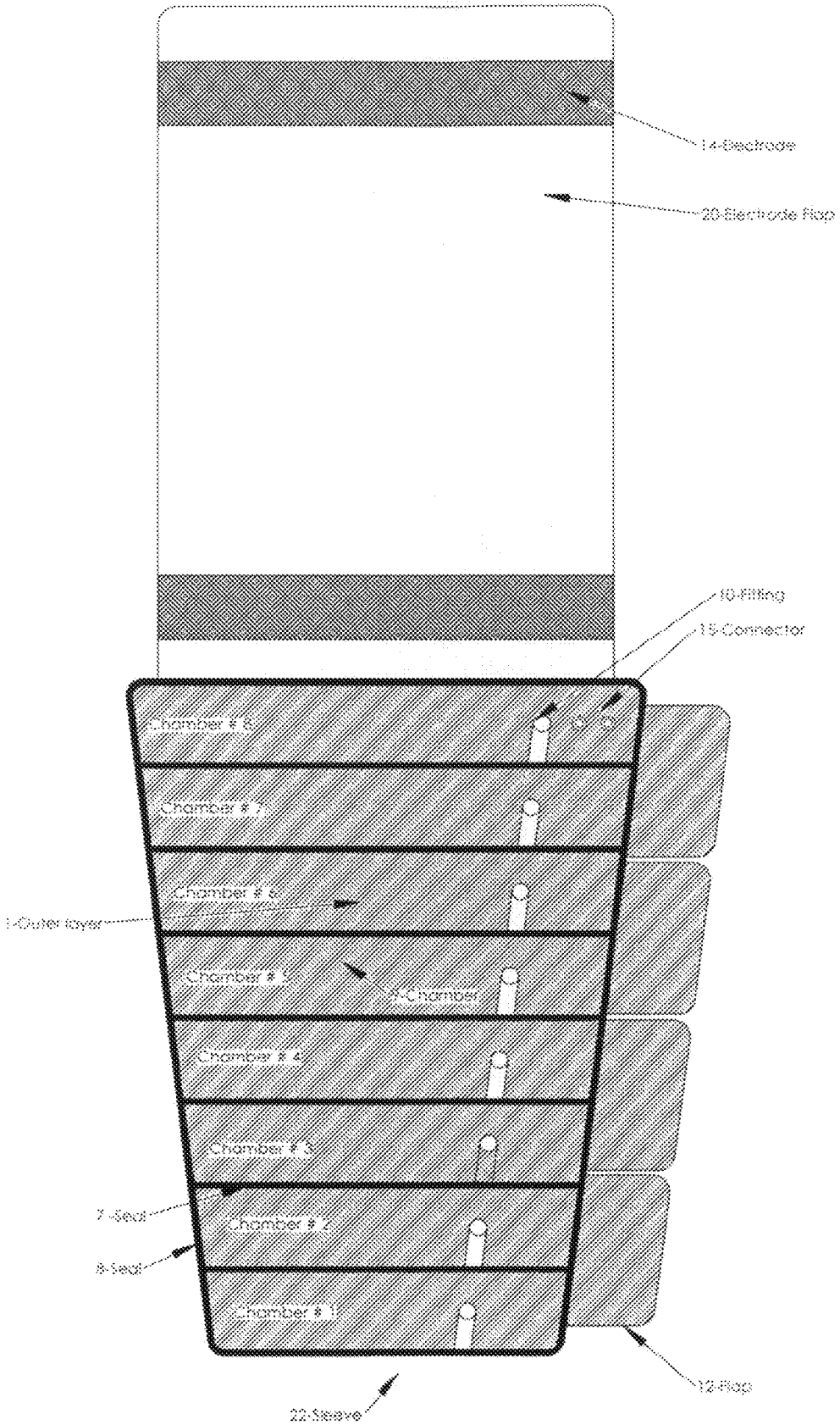
FIG. 4*a* is front view of an alternate embodiment of the compression sleeve of the present invention.
Figure 4B:
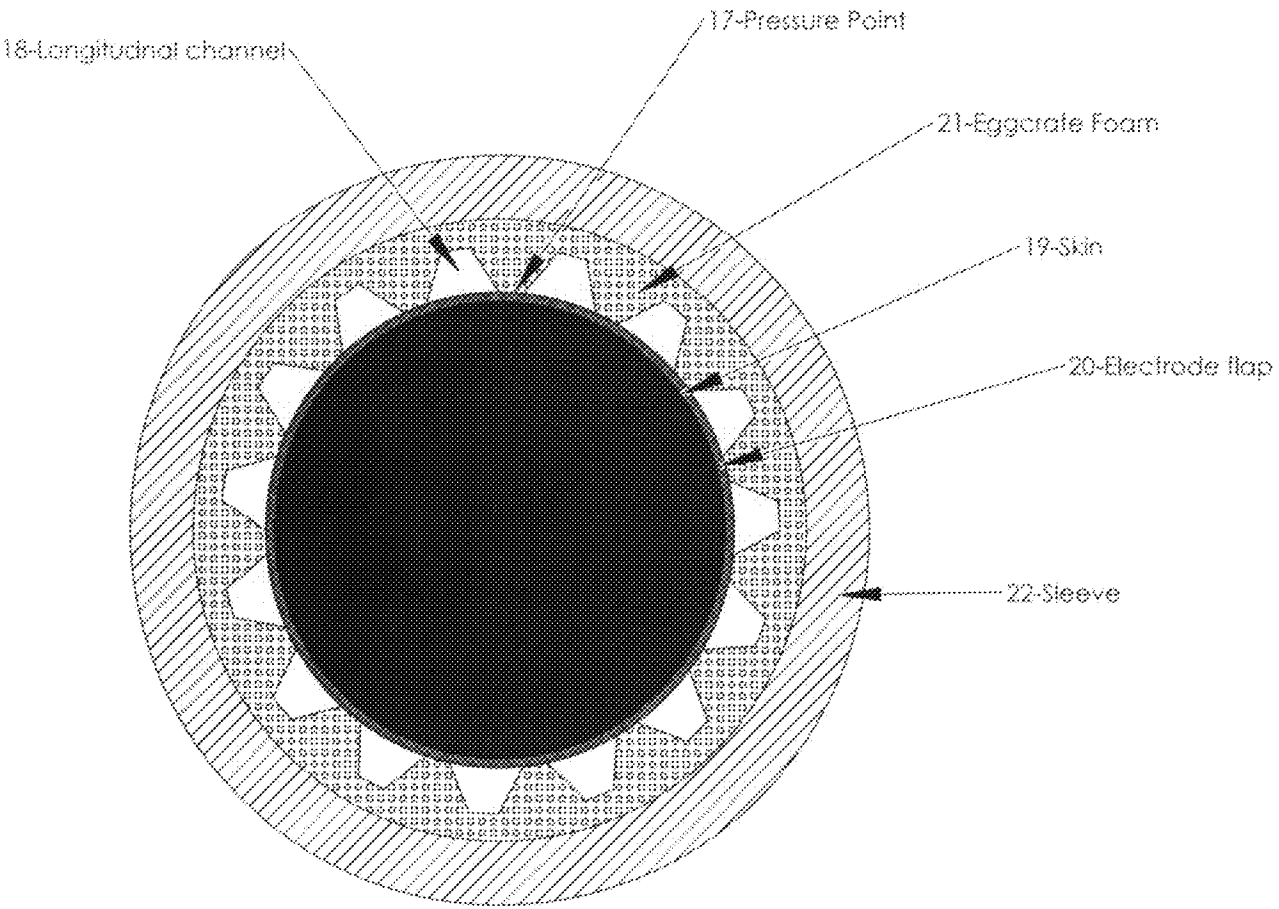
FIG. 4*b* is a cross-sectional view of a compression sleeve of the present invention wrapped around an extremity of patient.

Regarding certain lymphedema conditions, it may be desirable to create pressure points 17 on the arm with circumferential and longitudinal channels 18 for fluid flow and to allow "breathing" of the patient's skin 19. FIGS. 4*a*-4*b* show a sleeve 22 which is a modification of the sleeve 16 for such purposes. Sleeve 22 includes an elastic sheet 20 (called an electrode flap) which is attached to the upper edge of the sleeve 22 and includes embedded electrodes 14. The electrode flap 20 is placed on the patient's arm longitudinally so that the electrodes 14 come into electrical contact with the patient's skin. An "eggcrate" foam sheet 21 is wrapped around the patient's arm securing the electrode flap 20 to the arm. Sleeve 22 encases the eggcrate foam sheet 21 and is wrapped around the patient's arm and then is secured in place. Preferably, eggcrate foam sheet 21 is covered with a suitable cloth to prevent shedding of the foam during sleeve use.

Figure 5A:
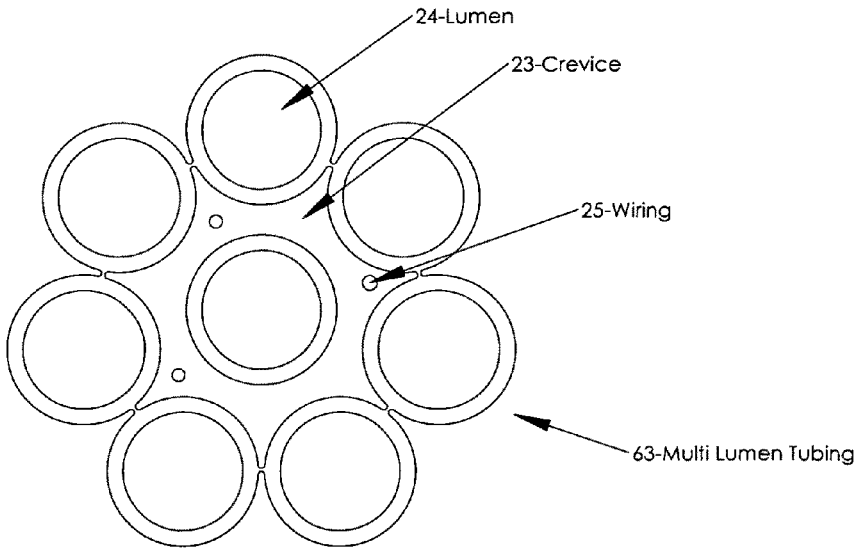
FIGS. 5(*a-b*) are cross-sectional views of air conduits (lumens) of the present invention.
Figure 5B:
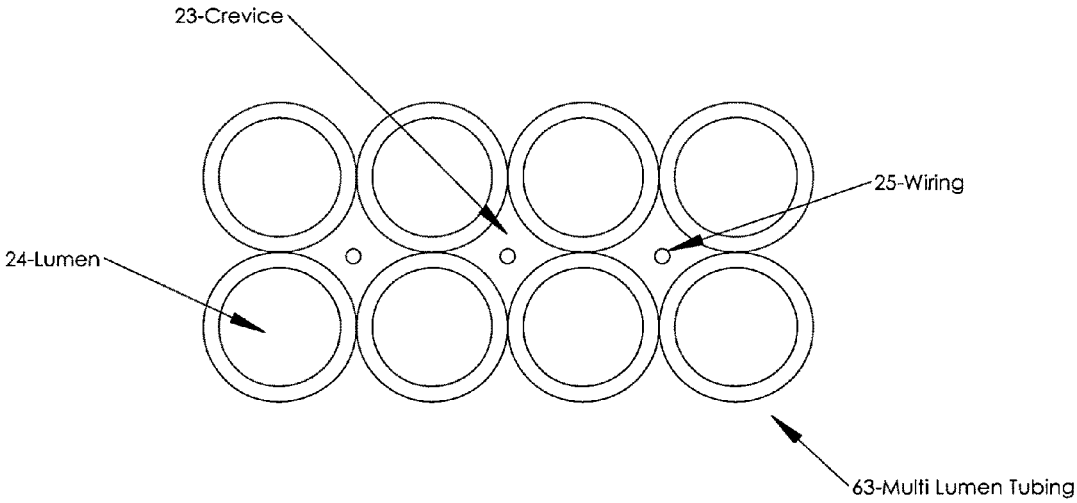

Multi-lumen tubing 63, as shown in cross section in FIGS. 5*a*-5*b*, connects the fittings 10 attached to the sleeve 16 and ultimately to the pump 40 (FIG. 6*c*) for inflation or deflation of the chambers 9. The multi-lumen tubing cross section may be either circular or planar with hollow spaces or crevices 23 located between the lumens 24. The electrical wiring 25 that connects the electrodes 14 to the biological impedance analysis and IFT circuitry 38 may be routed through the crevices 23 as an efficient packaging and routing technique. The lumens 24 effectively act as a sheath for the electrical wiring 25 and thereby providing an enhanced safety feature. Moreover, routing the electrical wiring 25 as described provides several other advantages such as protecting the wiring 25 from kinking & nicking during apparatus use and storage because the multi-lumen planar or circular cross-section offers more overall stiffness compared to individual tubes. A further advantage realized is enhanced ease of use since there is no clutter since a single multi-lumen tubing carries both the air and electrical wiring.

Figure 6A:
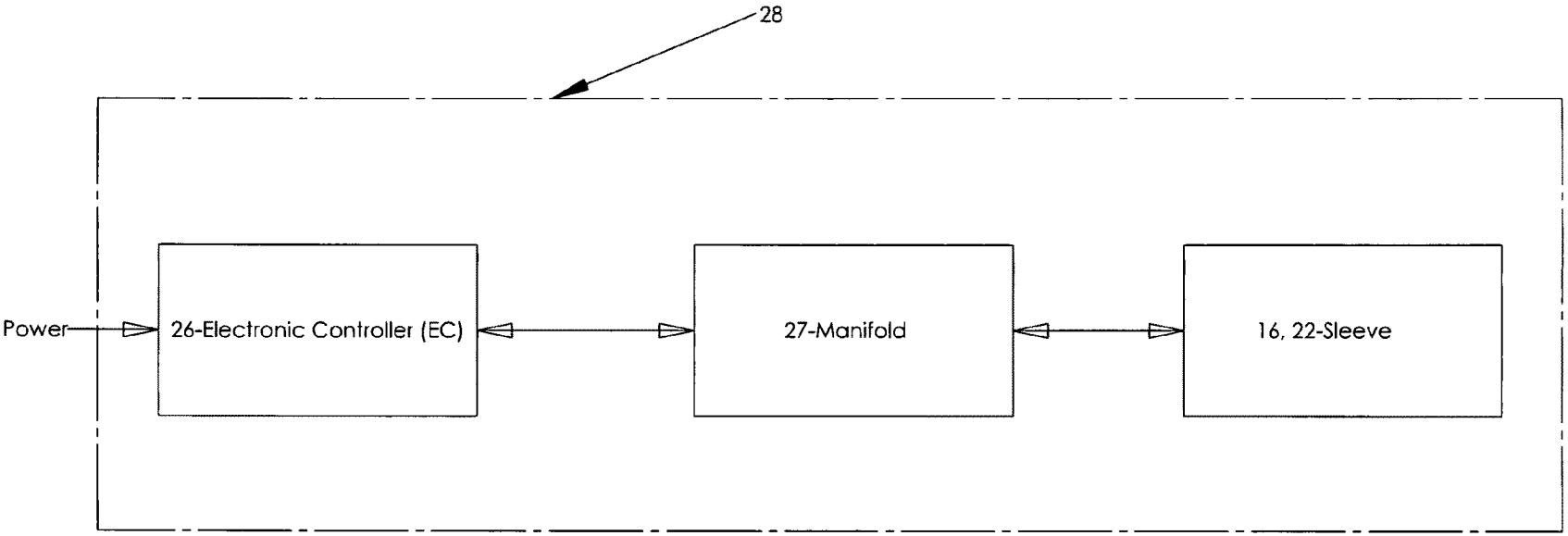
FIG. 6*a* is an overall block diagram of the lymphedema control system of the present invention.
Figure 6B:
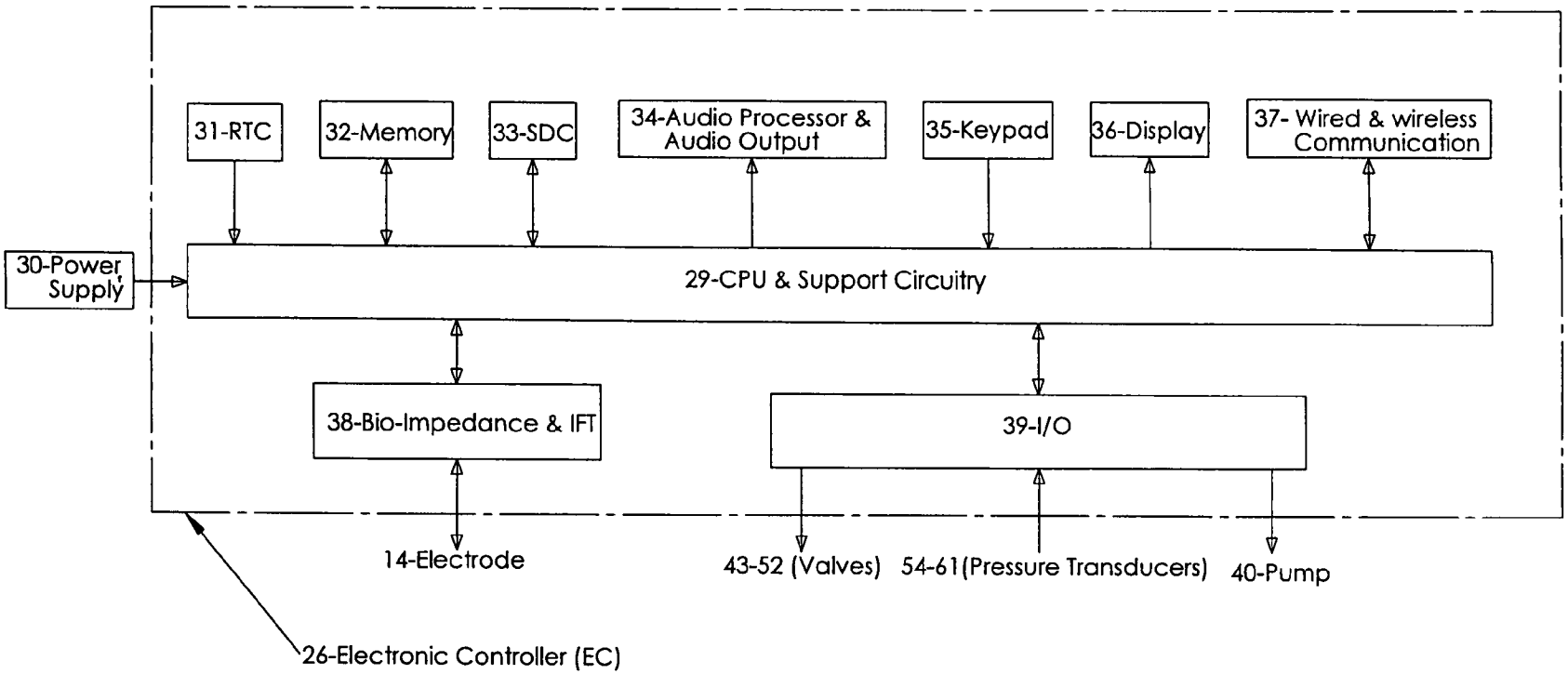
FIG. 6*b* is an overall block diagram of the electronic controller of the control system of FIG. 6*a;*

The operation of the sleeves (16 and 22) is controlled by lymphedema control system (LCS) 28. An example embodiment of the lymphedema control system 28 is shown in the block diagram of FIG. 6*a*. The LCS 28 comprises two main components (modules), an electronic controller (EC) 26 and pneumatic manifold 27. An example block diagram of the electronic controller 26 is shown in FIG. 6*b*. A main component of electronic controller (EC) 26 is a processor 29. The processor 29 may be an ASIC configured to carry out a preselected lymphedema treatment protocol and issue commands to the various components such as for example, to the pump 40 and the valves 43-52 in carrying out an inflation/deflation cycle or a general purpose computer programmed to carry out the algorithm shown in FIGS. 8*a*-8*e*. The overall apparatus is powered by a low voltage DC power supply (less than 48V) 30. This has several advantages such as protecting patient's safety against electrical shock. The apparatus may also be powered by a battery such as a car or airplane battery or an electrical chair making the apparatus very portable thus giving enhanced mobility to patients. Universal AC to DC converters such as used in laptop computers may also be used thus removing the problem of AC power supply incompatibility in different countries.

EC 26 has an on-board battery backed real time clock (RTC) 31, memory 32, secure digital card (SDC) 33, an audio processor 34 with a buzzer/speaker, a keypad 35, a display 36 and wired and wireless communication 37, biological impedance measurement and IFT circuitry 38 and input/output (I/O) circuitry 39. RTC 31 keeps track of time as well as the current day and date. RTC 31 is also used to log the frequency, duration and time/day of the lymphedema treatment and to set an alarm to remind the patient that a lymphedema treatment is due. Multiple alarms may be set in a 24 hour period. RTC 31 also provides a reminder for the equipment service schedule times and total use time. The flash memory 32 is used to store patient information (name, ID No., etc), the patient treatment profile/protocol (such as pressure profile of the various chambers, inflation sequence of the chambers, dwell time between each chamber—the time interval before starting to inflate the next chamber, rate of inflation of the chambers, number of cycles a sleeve is pressurized/inflated and depressurized/deflated for different sleeves used for an arm or leg, etc. SDC 33 may be used to transfer data from the apparatus to a physician without the necessity of having to take the apparatus to the physician's office. The SDC 33 may be programmed by a physician to create a new treatment protocol as the lymphedema treatment progresses. EC 26 also includes the capability to store multiple treatment protocol for a patient such as one treatment protocol for the morning and a different treatment protocol for the evening.

Audio processor 34 provides audible information regarding the current lymphedema treatment, alarm triggers and conditions and instructions about the use of the apparatus. A keypad 35 integrated into the apparatus permits entry of various commands such as starting and stopping the lymphedema treatment, accessing the status of the apparatus and the lymphedema treatment and adjusting the audio volume, as mere examples. However, keypad 35 does not permit modification of the treatment protocol variables. A display 36 attached to the device displays visual information about the lymphedema treatment status, treatment parameters, alarm conditions, etc. EC 26 also has wired and wireless communication interfaces (such as RS232, RS485, USB, LIN) to enable communication with an additional computer or PDA. A graphical user interface (GUI) (not shown) which is only accessible by service technicians permits reading, setting and modifying various hardware related parameters of the LCS 28 such as the number of chambers in the sleeve to be used, pressure sensors calibration, parameters related to the servo control of the pressure in chambers. Another GUI, only accessible to a physician and lymphedema therapy specialists permits adding, deleting and changing the treatment protocols. The wireless interface such as the wireless interface sold under the registered trademark ZIGBEE allows the use of a handheld remote control which can initiate all the commands available using of the keypad. This makes the apparatus very easy to use since the apparatus does not have to be within physical reach of the patient. A hand held remote can also undertake the same functions as keypad 35, display 36 and audio processing 34. EC 26 includes circuitry 39 to turn all the valves and pump on and off as desired as well as circuitry (39) to monitor pressure transducers that measure pressure in each chamber. EC 26 further includes circuitry 38 that provides for application of low voltage AC/DC, pulsed and non-pulsed prescribed electrical signals to the electrodes 14 embedded into the sleeve 16 that come in contact with the skin of the patient. A suitable conductive gel may be applied to the skin of the patient before the sleeve is attached so as to provide good electrical contact between electrodes 14 and the patient's skin. The gel provides for enhanced interferential therapy applied to the extremity to which the sleeve 16 is wrapped around. The EC 26 provides performance of quantitative biological impedance measurements to monitor the effectiveness of compression and interferential therapies and assessment of the lymphedema condition.

Figure 6C:
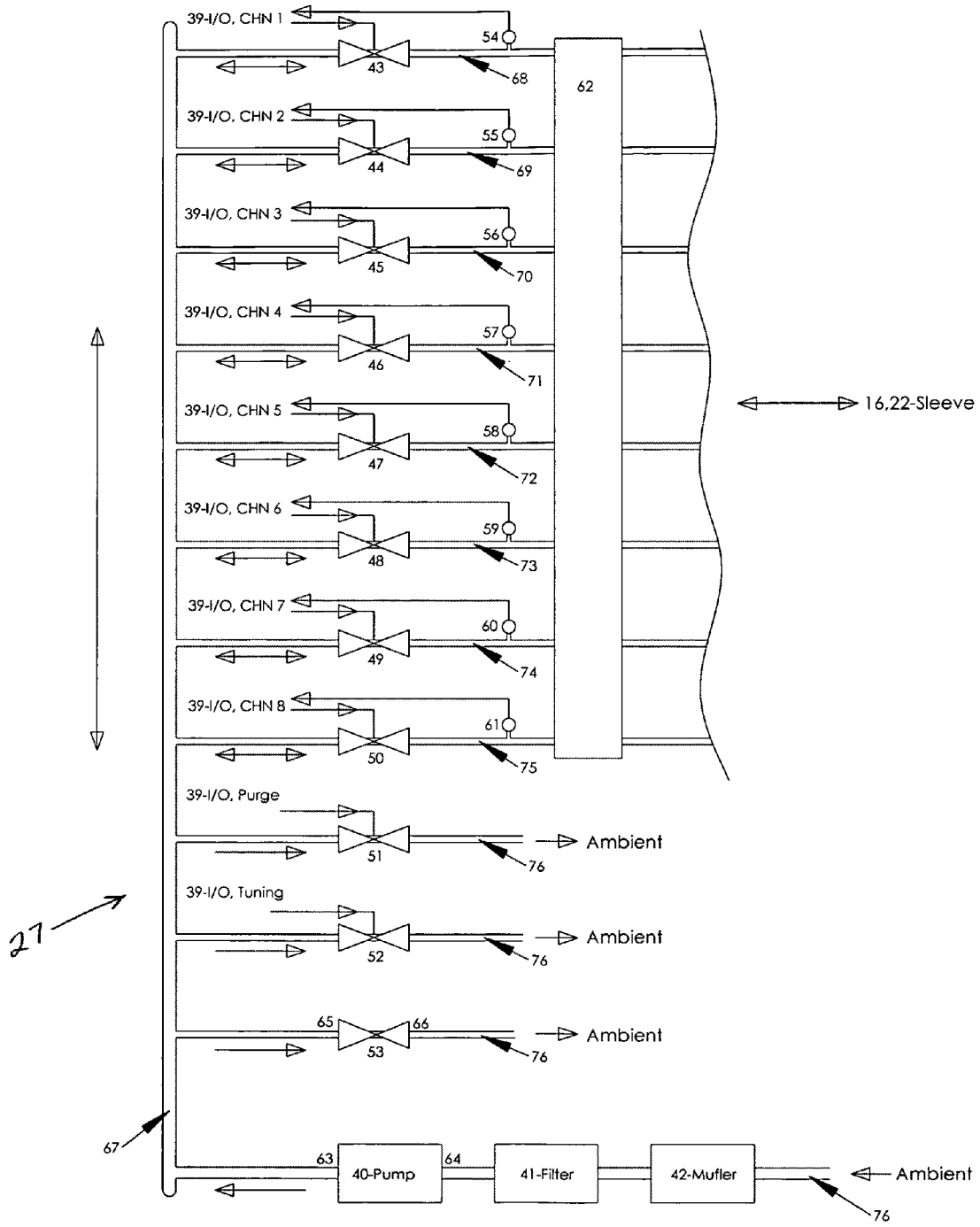
FIG. 6*c* is a schematic diagram of the pneumatic manifold arrangement of the present invention.

A block diagram of a pneumatic manifold 27 is shown in FIG. 6*c*. The output port 63 of a pneumatic pump 40 is attached to a manifold duct 67. The input port 64 of the pump 40 is pneumatically connected to a particulate filter 41 and a muffler 42. The particulate filter 41 is configured to prevent any particulate matter from entering the manifold 27 and the muffler 42 is configured to minimize any noise generated by the air flow to the manifold 27. A two port, normally closed solenoid valve, identified as inflation/deflation (I/D) valve 43 is positioned between the pump 40 through duct 67 and the first chamber (CHN 1) of the sleeve 16 or sleeve 22 as the case may be. In a similar arrangement, I/D valves 44-50 are positioned between the pump 40 through duct 67 and sleeve chambers CHN 2-8, respectively. Although an eight chamber sleeve has been described herein, it is to be understood that the number of channels, greater than one, is a design choice and may be altered depending upon use considerations. As discussed and shown in FIG. 6*c*, one port of I/D valve 43 is pneumatically connected to duct 67 in the manifold and the other port of I/D valve 43 is connected to duct 68 in the manifold which is pneumatically connected to CHN 1 of sleeve 16. In a similar arrangement, I/D valves 44-50 are connected to ducts 69-75 respectively which in turn are pneumatically connected to sleeve CHN's 2-8, respectively. The I/D valve of each sleeve chamber 9 permits inflation/deflation of the respective sleeve chamber. A temperature compensated pressure transducer 54 is pneumatically connected to duct 68. Duct 68 in turn, is connected to CHN 1 of sleeve 16 through a multiport connector 62 and multi-lumen tubing 63. Pressure transducer 54 permits monitoring of the pressure inside chamber 1 (CHN 1) so that EC 26 may cause the respective chamber pressure to be maintained at its prescribed value during a treatment protocol. In a similar arrangement pressure transducers 55-61 are connected to ducts 69-75 respectively for monitoring the pressure in CHN's 2-8, respectively. Also in a similar arrangement ducts 69-75 are connected, through multiport connector 62 to multi-lumen tubing 63 which connects to CHN's 2-8, respectively. A two port, normally closed purge valve 51 is also pneumatically connected to manifold 27. The purge valve 51 has a valve orifice, through which air flows, that has a cross-sectional area about 5 times larger than the cross-sectional area of the orifice of I/D valve 43. Accordingly, the purge valve 51 is capable of providing rapid discharge of air in the manifold 27 to the ambient environment. As noted, one port of the purge valve 51 is pneumatically connected to the duct 67 of manifold 27 while the other port of the purge valve discharges into the ambient environment 76. Under the control of EC 26, the purge valve 51 provides for rapid and complete deflation of the sleeve chambers. A two port, normally closed tuning valve 52, is also pneumatically connected to the manifold 27. The cross-sectional area of the tuning valve orifice is about 5 times smaller than the cross-sectional area of the orifice of I/D valve 43. The tuning valve 52 provides for removal of small amounts of air from the sleeve chamber/s to adjust the air pressure in the chamber/s to a prescribed value. The tuning valve 52, due to its small orifice, provides for better control of the amount of air removed from the sleeve chamber/s compared to purge valve 51. A mechanical over-pressure relief valve 53 is pneumatically connected the manifold 27. The input port 65 of the over-pressure relief valve 53 is pneumatically connected to duct 67 and the output port 66 of the over-pressure relief valve 53 discharges into the ambient environment 76. The over-pressure relief valve 53 provides for a fail-safe operation in cases of malfunction of the pneumatic system.

Figure 7A:
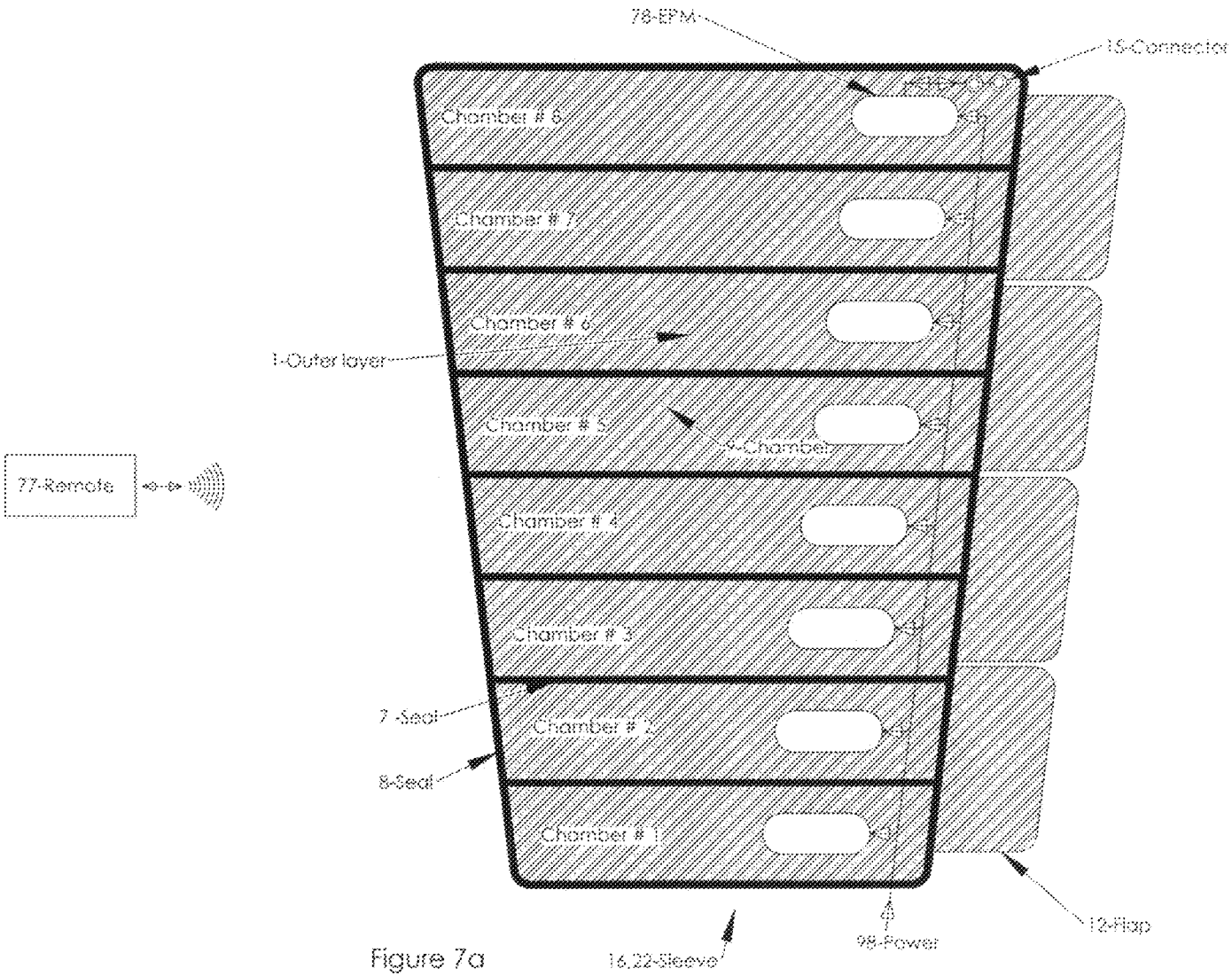
FIG. 7*a* is a front schematic view of an alternate embodiment of the present invention utilizing a respective EPM in pneumatic communication with each individual compression sleeve chamber.
Figure 7B:
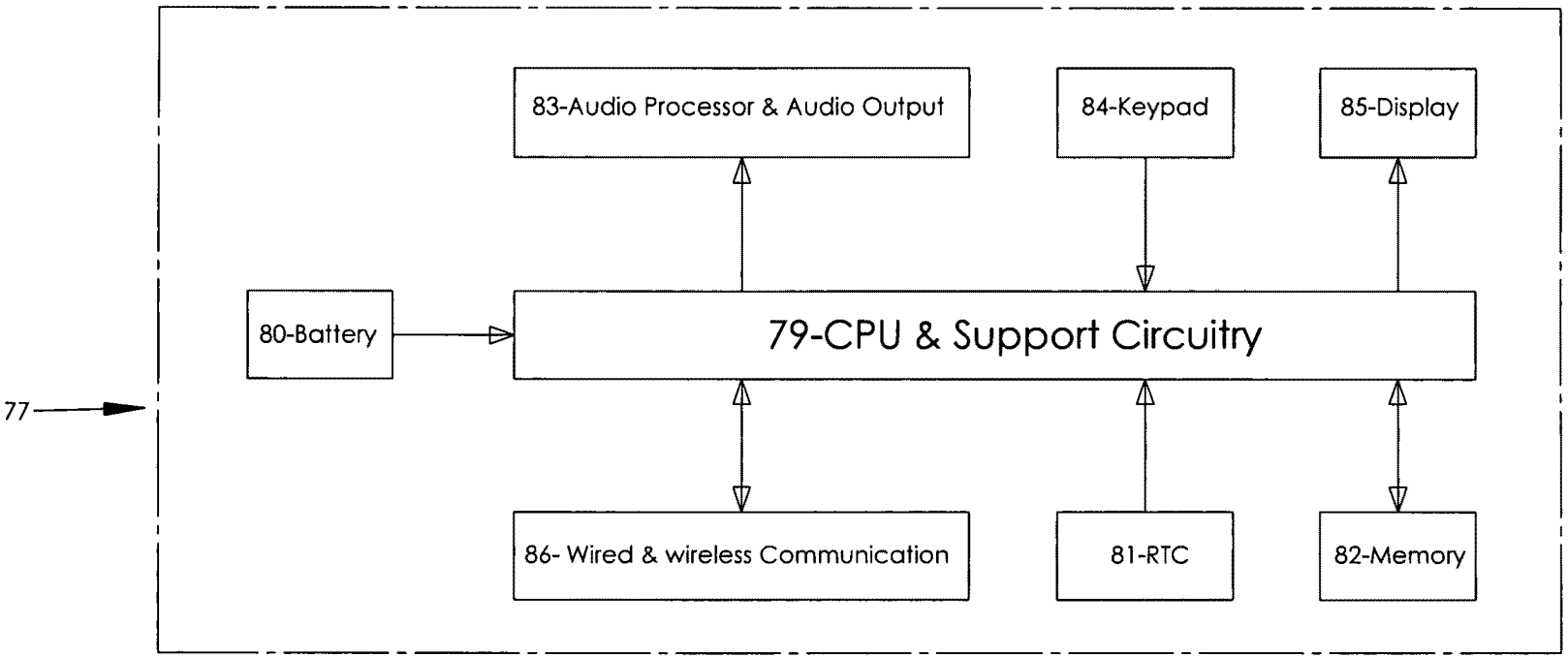
FIG. 7*b* is a block diagram of a remote control unit used in conjunction with the present invention.
Figure 7C:
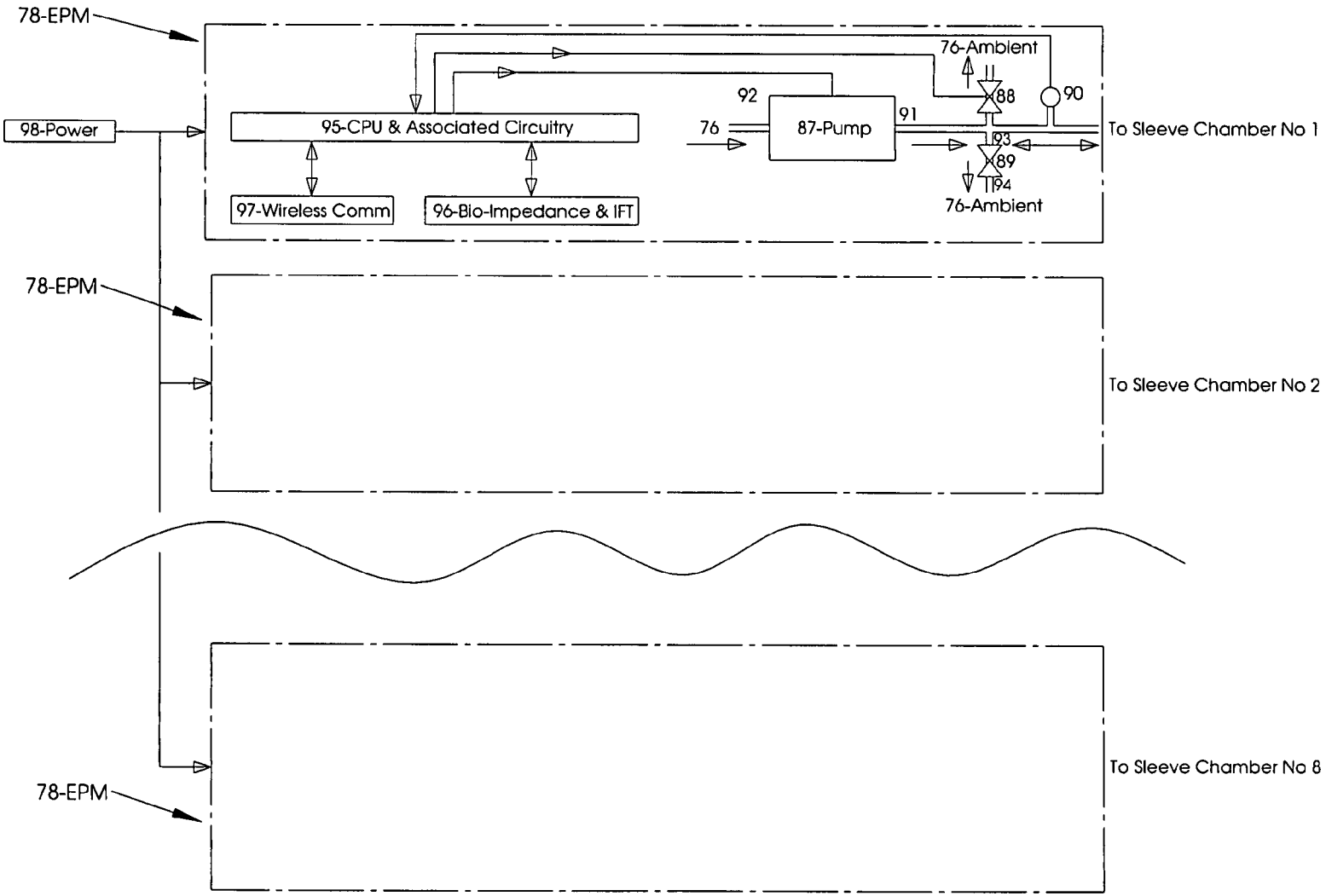
FIG. 7*c* is an overall block diagram of an EPM as used in conjunction with an example eight chamber compression sleeve.

Another example embodiment of the LCS 28 is shown in FIG. 7*a*. The embodiment shown in FIG. 7*a* comprises two main components (modules), namely, remote unit 77 and electro-pneumatic module 78 (EPM). An example electrical block diagram of the remote unit 77 is shown in FIG. 7*b*. The heart of the remote unit 77 is a processor (CPU) 79 powered by a battery 80. It also has an on-board battery backed real time clock (RTC) 81, memory 82, an audio processor 83 with audio processing capability using a buzzer and speaker, a keypad 84, a display 85 and a wired & wireless communication module 86 to interface with a computer and the EPM's. When communicating with a computer, remote unit 77 acts as a "slave" to the computer (master) and when communicating with EPM modules, the remote unit 77 acts as a master. A block diagram of the EPM 78 is shown in FIG. 7*c*. The heart of an EPM is an integrated miniature air pump 87 and a two-port normally closed purge valve 88 driven by elastomers called electroactive polymers (EPAM). EPAM is currently available from Artificial Muscle Corporation of Redwood City, Calif. Also included in this embodiment is a mechanical over-pressure relief valve 89 assembly connected to each sleeve chamber. The pump output port 91, an input port of the purge valve 88 and input port 93 of the over-pressure relief valve 89 are pneumatically connected directly to a sleeve chamber. Input port 92 of the air pump 87, an output port of the purge valve 88 and an output port 94 of the over pressure relief valve 89 discharge into the ambient environment 76. A pressure transducer 90 installed between a sleeve chamber and air pump 87 measures the pressure in a respective sleeve chamber. The pump 87 and the purge valve 88 are under the control of a local CPU (processor) and its associated circuitry assembly 95. Biological impedance measurement and IFT circuitry 96 are also located on this assembly and are controlled by the local CPU. Wired and wireless communication interface 97 located on the assembly provides for communication between the remote unit 77 and an EPM 78. An external power source 98 provides power to all the electronics, valves and pumps of an EPM.

In this embodiment, I/D valves are not required because each sleeve chamber is pressurized individually by its own EPM pump instead of sharing a common pump. Each sleeve chamber has its own deflation/pressure adjustment valve rather than sharing common purge and tuning valves. This arrangement permits inflation or deflation of any chamber concurrently with other chambers. For example, while one sleeve chamber is being inflated, another sleeve chamber may be deflating to adjust its pressure concurrently or two chambers may be inflating concurrently independently of each other. Each sleeve chamber has its own EPM installed on the sleeve. All EPM's are under the direct control of the remote unit 77 which performs the same functions as the LCS 28 of the earlier described embodiment, except the sleeve control functions are performed by EPMs. Any EPM can perform biological impedance measurement and IFT functions depending on which EPM is connected to the electrodes 14. Each EPM has its own ID number (set by switches or programmed into the CPU) which is same as the respective sleeve chamber number. This allows the remote unit 77 to communicate with each EPM directly.

Electroactive Polymer Artificial Muscle (EPAM) has significant differences from not only conventional electromagnetic actuators but from other technologies like piezo-electric crystals and shape memory alloys. A significant advantage that EPAM has over electromagnetic actuators is its energy density, that is, more energy created for the mass of the actuator itself. Compared to shape memory alloy and piezo electric technology, EPAM's have a significant direct displacement advantage. While shape memory alloy and piezoelectric technology might achieve a 1% direct displacement, EPAM actuators can reach 20% or more displacement levels over long life cycles. Compared to conventional electromagnetic motors, EPAM's have a significant advantage in power density. EPAM's will provide the same level of power as an electromagnetic motor device but with a much smaller and lower weight form factor, much like the human muscle. The EPAM basic architecture is made up of a film of an elastomer dielectric material that is coated on both sides with another expandable film of a conducting electrode. When voltage is applied to the two electrodes, a Maxwell pressure is created on the elastic dielectric polymer layer. The elastic dielectric polymer acts as an incompressible fluid which means that as the electrode pressure (voltage) causes the elastomer dielectric film to become thinner, the dielectric film expands in planar directions and thus provides mechanical actuation and motion. Advantageously, EPAM's can be patterned to pinpoint actuation in multiple locations.

Before commencing CT and/or IFT, a quantitative measurement of the biological impedance of the extremity afflicted with lymphedema is performed using a bio-impedance (biological impedance) analysis (BIA) methodology. BIA is based on two important concepts namely: a human body contains water and conductive electrolytes (collectively "fluids") and the electrical impedance of a body part such as an extremity (limb) is related to the length and cross-sectional area of the extremity, as well the frequency of the electrical current applied to the extremity. For the most part, body fluids conduct the electrical current that passes through a limb. Fluids are present both inside a human body cell, called intracellular fluid and outside the human body cells, called extracellular fluid. At low frequency, electrical current passes through the extracellular fluid and does not penetrate the cell membrane. At high frequency, however, electrical current passes through both the intracellular and extracellular fluids. By using a fixed strength electrical current, the bio-impedance of a limb can be measured which is inversely proportional to the amount of fluid in the limb. Accordingly, as the fluid in the limb decreases, the bio-impedance will increase. Bio-impedance analysis may be performed by any of one of three methods. Single frequency analysis is generally performed at about 50 kHz. At this frequency, the electrical current passes through both the intracellular and extracellular fluids. Based on this measurement total body water can be calculated. However, since the current passes through both the intracellular and extracellular fluids, it is not possible to determine the intracellular fluid alone. The results are based on predictive algorithms derived from healthy subjects. In multi-frequency bio-impedance analysis, the impedance is measured at no greater than seven different frequencies. Empirical linear regression analysis is then used to derive the impedance values. In bio-impedance spectroscopy, impedance is measured at 256 different frequencies and mathematical modeling is used to calculate the impedance values.

A data entry listing for an example treatment protocol (profile) having either compression therapy or interferential therapy parameters or both loaded into the memory of the EC 26 is shown in Appendix A. Multiple protocol's may be stored in the memory of the EC 26 for rapid access and use. For the present discussion, the input data for the sleeve chambers will refer to chamber one (CHN1) of the sleeve with the understanding that the other chambers of the sleeve have similar data entries. A thorough description of the execution of a lymphedema protocol with reliance on a similar entered data listing will be described below with reference to FIGS. 8*a*-8*e*. The compression therapy (CT) parameters include pressure set point for all the chambers (101), sequence of inflation of the chambers (102), dwell (pause) time (103) for each chamber (the time interval after inflating a chamber to a pressure set point before starting inflation/deflation of the next chamber(s), sequence end delay (105) (time interval after inflating all the chambers and start of the deflation cycle), sleeve deflation period after the end of inflation cycle (115), "end of treatment" parameters (104) which includes the number of inflation/deflation cycles to occur for the treatment, a fixed amount of time for the treatment, attainment of a prescribed percentage of the original measured biological impedance, attainment of a fixed value of impedance value or a combination of the above parameters. The lymphedema treatment is terminated when any of the "End of Treatment" parameters are met. Any sleeve chamber can be set to stay inflated (106) throughout the treatment. This is especially true for the chamber at the proximal end of the sleeve when wrapped around a body extremity such as a hand or foot. Since a foot, for example, is at the distal end of a patient's leg, lymph fluid can only go out from and away from the foot along the patient's leg towards the groin, where the distal end of the sleeve is located and thus there is no need to deflate the sleeve chamber at its proximal end to permit the lymphatic fluid from entering the patient's foot. The product of a chamber pressure set point and corresponding dwell time is generally maintained at a constant value for all the chambers so that approximately same amount of lymphatic fluid moves along in the treated limb from chamber to chamber during inflation. These programmable parameters also provide the versatility of programming monotonically decreasing, monotonically increasing or constant pressure gradients in the sleeve. The IFT parameters include the amplitude of applied voltage (AC/DC) (107), pulse duration (108), pulse rate (109) and "end of treatment" parameters which are same as for the CT. The treatment protocol also contains treatment related parameters such as protocol number (111), protocol name (arm, leg, etc.)(110) and patient related parameters such as name (112), social security number (SSN) (113), etc. Sleeve related parameters include the number of chambers (114).

Figure 8A:
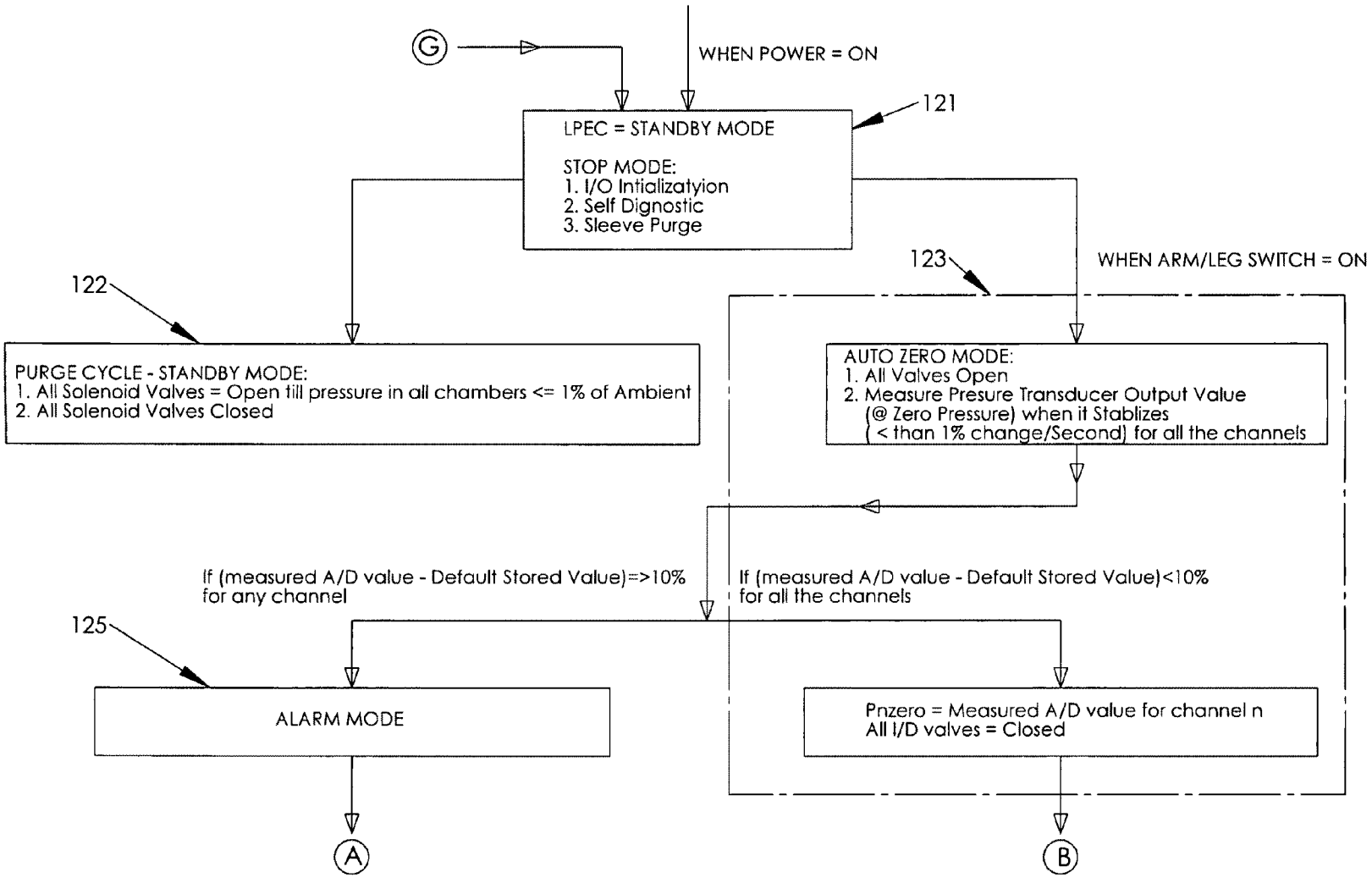
FIGS. 8(*a-e*) is a detailed flow chart describing the functional steps defining the overall operation of the lymphedema control system of the present invention.
Figure 8B:
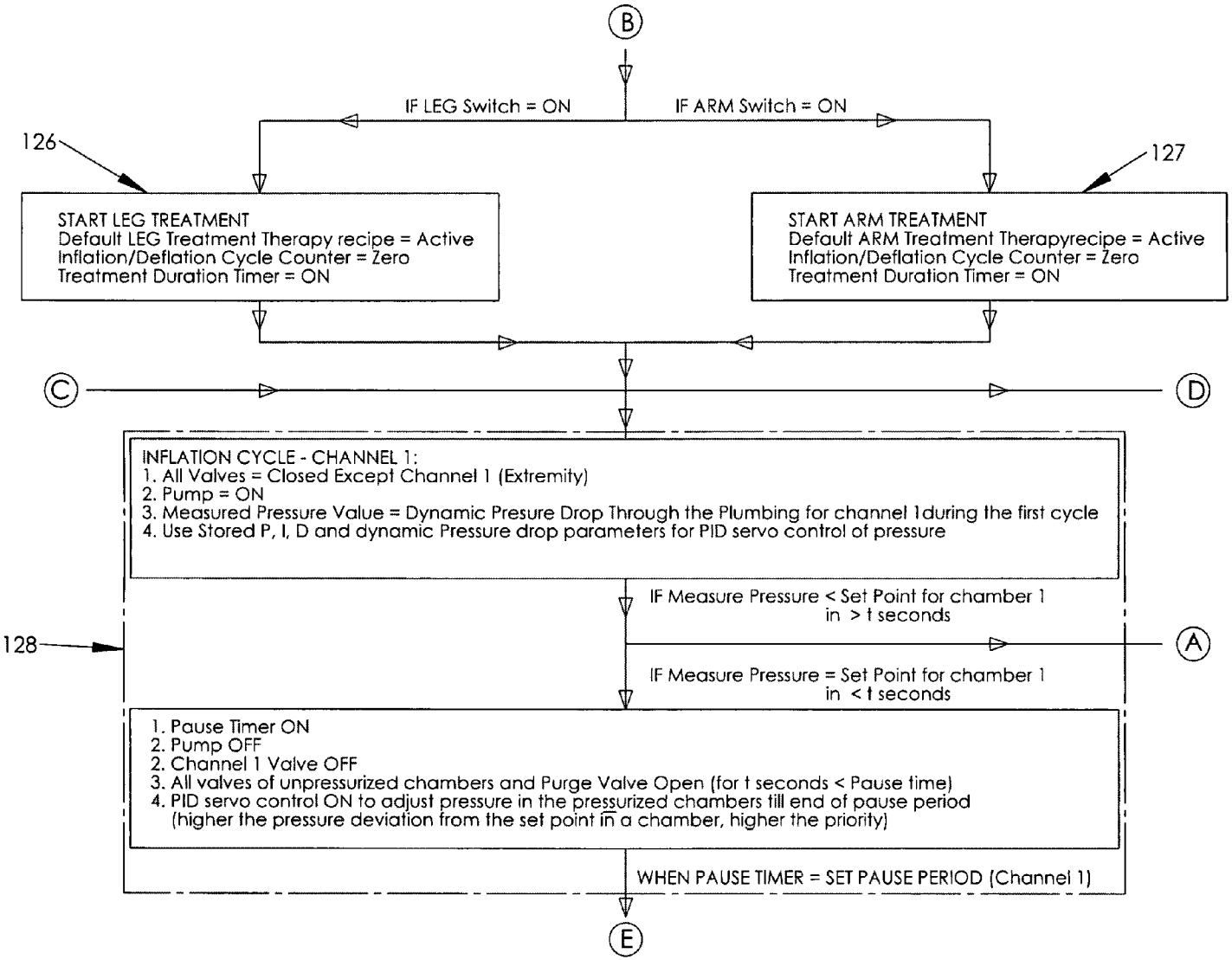
Figure 8C:
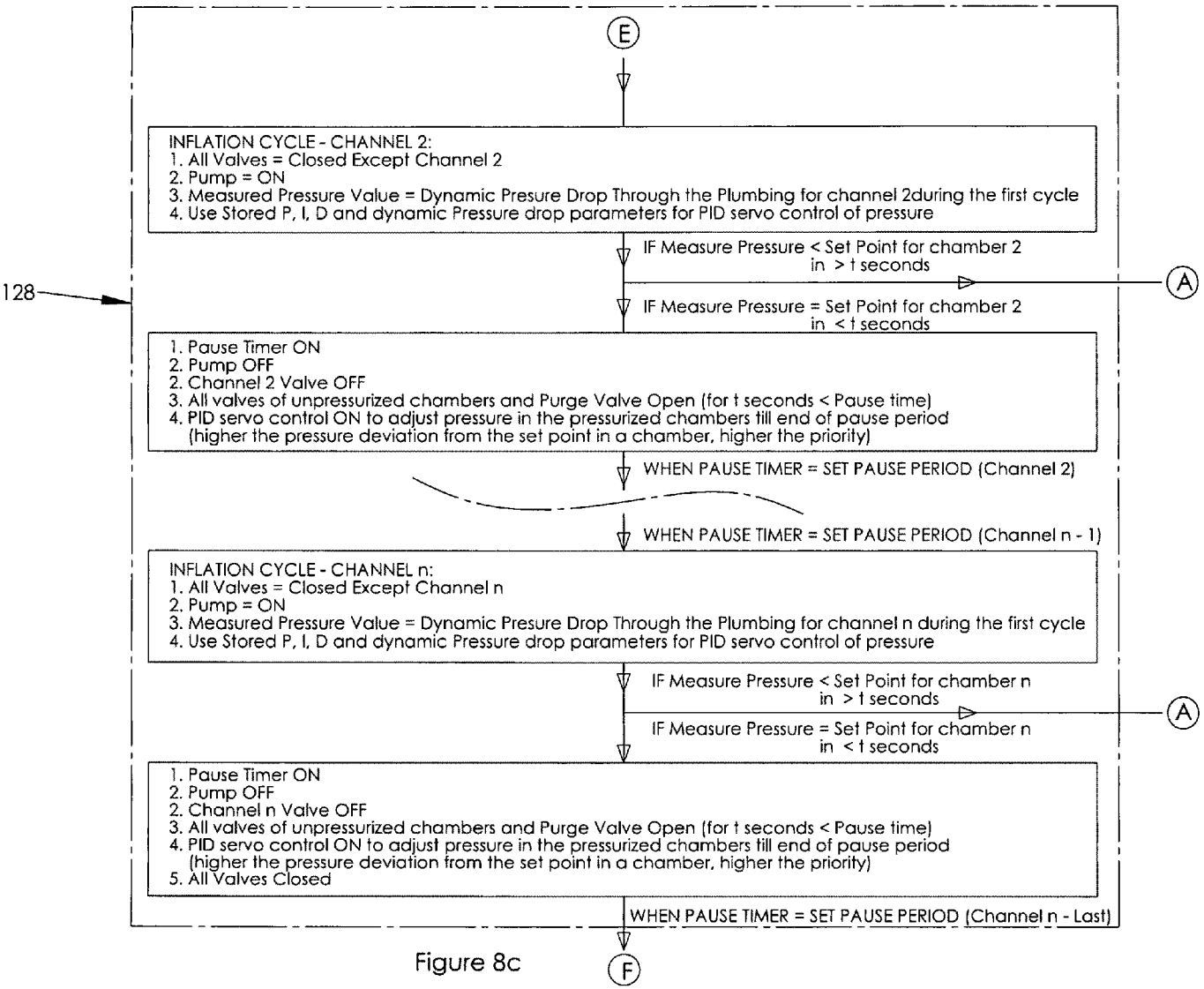
Figure 8D:
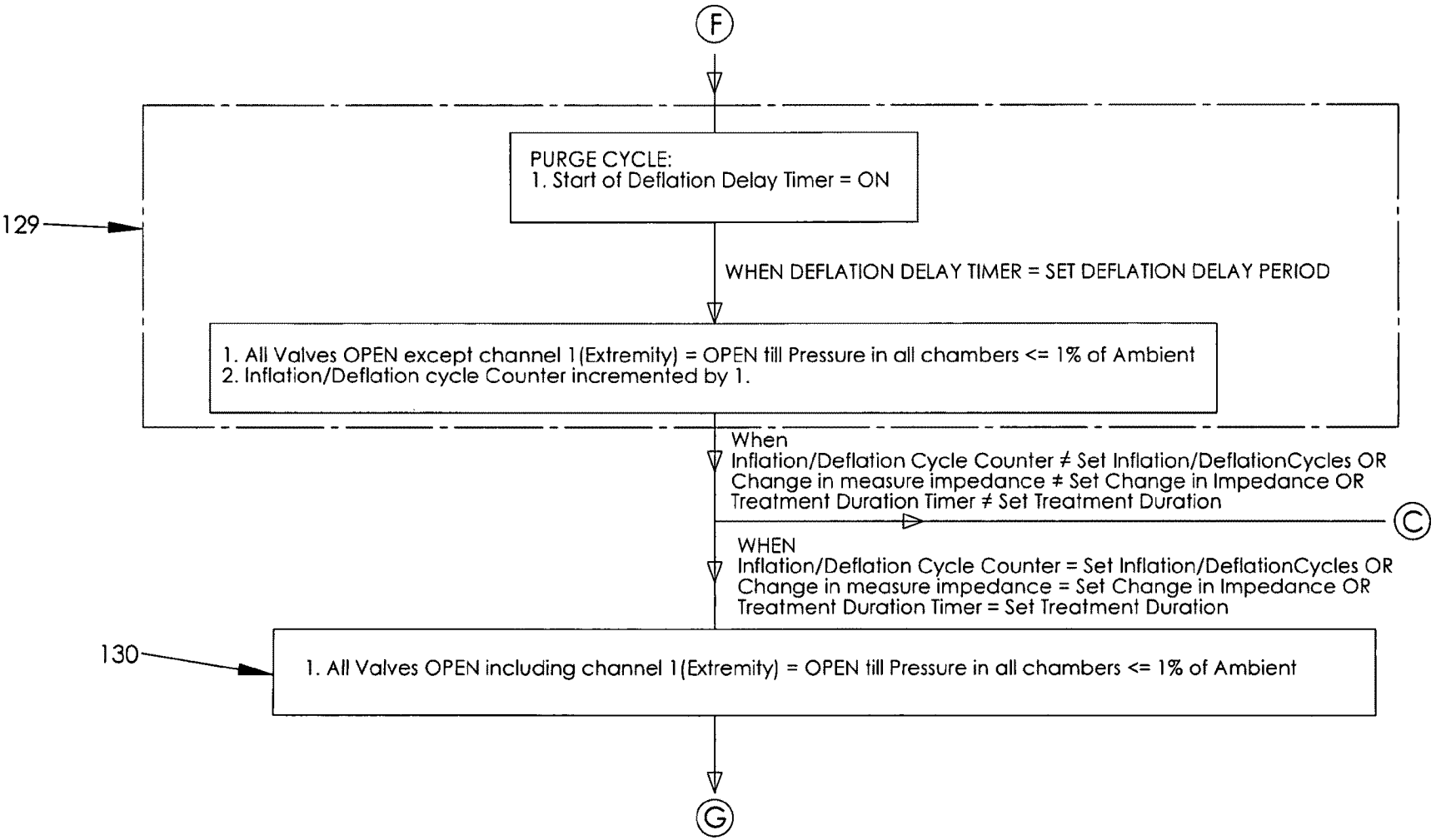
Figure 8E:
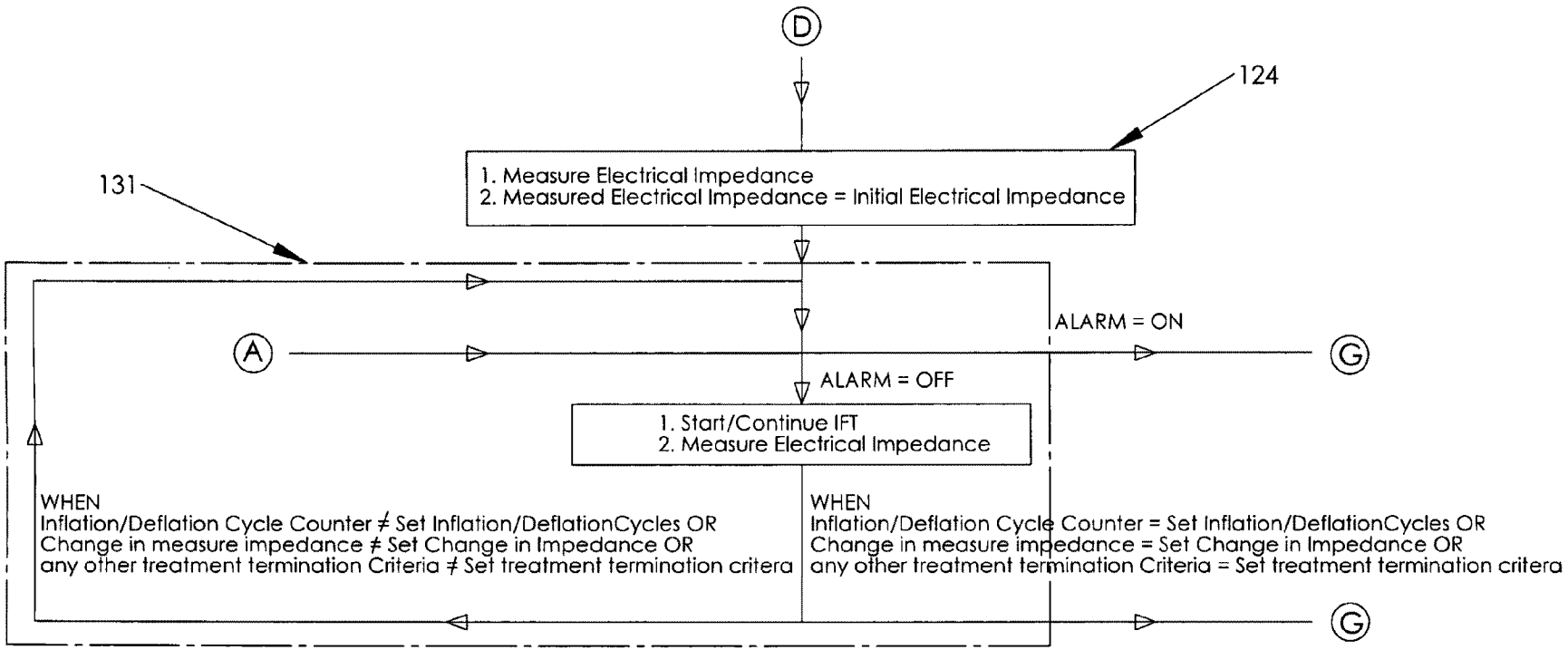

Referring now to FIGS. 8*a*-8*e*, there is shown an example flow diagram of a program, preferably cast in firmware that controls the operation of LCS 28. In the FIGS. 8*a*-8*e*, the lines connected to circled letters A-G are to be considered connected to lines connected to like circled letters throughout FIGS. 8*a*-8*e* to establish line continuity. For example, the line ending at © in FIG. 8*b* is connected to the line ending at © in FIG. 8*d*, and so on. Upon application of power to the LCS 28 (system power switch on), the CPU and the Support Circuitry 29 the EC 26 is reset, all the I/D valves 43-51 are set to closed position, and the pump 40 is in off condition. LCS 28 goes into a standby mode 121 which is shown on the display 36 as well as an audio message "power on" is announced. In the Standby Mode 121, the treatment protocols may be loaded, erased, modified or an established treatment protocol can be set to a default treatment protocol for a particular limb positioned on sleeve 16. The default treatment protocol is executed when the Treatment Start button is pressed either from the remote control 77 or keypad 35. During the standby mode 121, the purge cycle 122 can be initiated from the keypad 35 (all the I/D valves 43-52 are opened) thus removing any air from the sleeve which facilitates mounting the sleeve on the extremity to be treated. When a Start command is pressed from the keypad 35, an autozero cycle 123 is started. The display 36 displays the notation "Starting Treatment" and the audio processor 34 announces "Start of Treatment". In the auto zero cycle 123, all I/D valves 43-52 are opened so as to deflate all the sleeve chambers thus equalizing the pressure inside and outside sleeve 16. The pressure transducers 54-61 continuously monitor (measure) the pressure inside each of the sleeve chamber(s) 9. When the measurements of all the pressure transducers 54-61 (after analog to digital A/D conversion) becomes stable and meet programmed criteria, the pressure inside and outside the sleeve 16 is indicated as becoming equal. At this time, all the pressure transducer (54-61) measurements are equivalent to measuring "zero" pressure. These values are stored in memory 32 and used to measure the correct pressure inside the sleeve chambers. This procedure compensates for any zero drift of the pressure transducers due to aging and temperature and electronic component drift. After completion of the auto zero mode 123, all I/D valves 43-52 are closed. If a pressure transducer stability criteria is not met, the apparatus goes into an alarm mode 125 and lymphedema treatment is aborted.

Upon completion of the auto zero mode 123, a lymphedema treatment cycle commences and depending upon the selected extremity, at 126 for an arm or at 127 for a leg with CT and IFT also starting according to the current active protocol. For CT, inflation cycle 128 commences and assuming that sleeve chamber 1 (CHN1) is pressurized first (as defined in Appendix A), the I/D valve 43 is opened and the pneumatic pump 40 is started to provide pressurized air to CHN1. The pressure transducer 54 located between the I/D valve 43 and the corresponding CHN1 of the sleeve monitors the chamber pressure. In one embodiment, the pressure transducer 54 is located close to I/D valve 43 and there is a measureable pressure drop between the pressure transducer 54 and the sleeve CHN1 due to the resistance, caused by friction, to the air flow through manifold duct 68 and the multi-lumen tubing 63. It is to be noted, that the longer the tubing 63, the higher the pressure loss. Initially the pressure inside CHN1 is zero. Therefore, the pressure reading from the pressure transducer 54 at the very beginning of the inflation cycle is equal to the pressure drop through the tubing 63 for CHN1 for the given flow capacity of the pump 40. This dynamic pressure drop is measured for all the chambers (channels) (1-8) during the first inflation cycle of all the chambers and stored in memory 32. This dynamic pressure drop parameter is used as an input parameter to a commonly available proportional integral derivative algorithm (PID) stored and performed in EC 26 to compensate for any error in pressure measurement in order to achieve the programmed pressure in the sleeve chambers, in the least amount of time without either over or under shooting the programmed pressure value. This automatic compensation of the dynamic pressure drop through the tubing 63 for each sleeve chamber alleviates the need to manually set these values and results in maintaining accurate pressure values in the sleeve chambers. Alternatively, pressure transducers (54-61) may be mounted very close or on the respective sleeve chambers. In such case, the pressure drop between a pressure transducer and the respective sleeve chamber is negligible, if any, but requires that the electrical conductors must be provided between the pressure transducers on the sleeve (16, 22) to the EC 26.

As has been previously described, sleeve (16, 22) may be formed of flexible elastomeric material. Accordingly, when a sleeve chamber is pressurized to its programmed value (set point), the chamber applies a force to the adjacent chamber. This force causes the volume of the adjacent chamber to decrease slightly, especially if the adjacent chamber is pressurized, resulting in pressure increase above its set point. There is also a pressure drop in the adjacent chamber due to cooling of the hot air that was caused by adiabatic heating of the air during the pressurization process. These two factors may cancel each other or there may be some plus or minus pressure change depending upon such factors as the size and design of the sleeve and the amount of adiabatic heating occurring during the pressurization process. During a delay interval (pause time 103) and after a sleeve chamber is pressurized, the EC 26 causes adjustment of the pressure of the adjacent chamber(s) to their respective set points (either by deflating the chamber(s) or by pumping more air in the chamber(s). However, simultaneous inflation and deflation of the chambers can not be done. The difference in the set point and the actual pressure in a chamber determines the priority of pressure adjustment during the dwell time 103, where the higher the difference, the higher the priority for pressure adjustment for the respective chamber. This continuous pressure control/adjustment of the chambers provides the capability of a monotonically decreasing, monotonically increasing or a constant pressure gradient along the length of the sleeve as defined by treatment protocol. At the conclusion of inflation cycle 128, a purge cycle 129 commences wherein all chambers but CHN1 are deflated. Subsequent to the completion of deflation of the desired chambers, the treatment termination criteria is checked. If any one of the treatment termination criteria has not been met, inflation cycle 128 is repeated. If any one of the treatment termination criteria has been met, purge cycle 130 commences wherein all of the chambers including CHN1 are deflated. At the end of purge cycle 130, EC 26 commands that the LCS 28 goes into standby mode 121.

Figure 9:
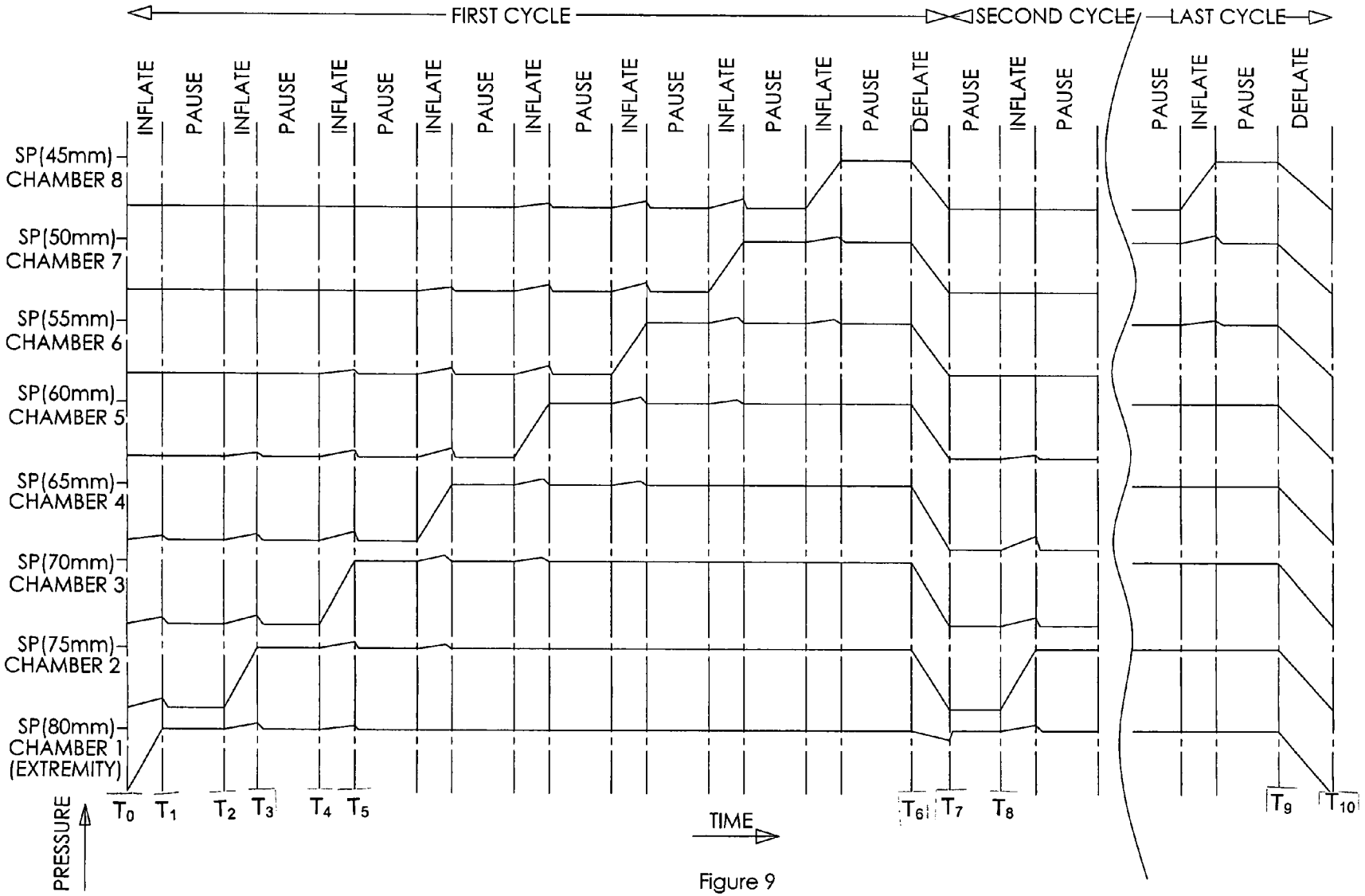
FIG. 9 is a time pressure graphical representation of the inflation/deflation cycle for the chambers of the compression sleeve.

At block 124, the IFT and biological impedance measurement cycle commences. The first biological impedance measurement value is stored in memory 32 and used as a reference and the IFT cycle 131 commences. The IFT cycle 131 is undertaken with the preselected electrical pulse parameters for IFT such as amplitude, duration and frequency such pulse signals being applied to the sleeve electrodes 14. The measured biological impedance values are then compared and displayed and when the treatment termination criteria is met, IFT is stopped and the device goes into standby mode. If IFT is being undertaken in conjunction with CT, any alarm in CT will also terminate IFT. FIG. 9 shows the pressure-time profile in the chambers of the sleeve during compression therapy treatment cycle.

A time pressure graphical representation of the inflation and deflation cycle for the eight chambers of the sleeve (16, 22) is shown in FIG. 9. At To, the initial starting time for the compression therapy, all of the sleeve chambers are completely deflated. At such time, EC 26 commands that inflation of chamber one (CHN1) commences. At T1, the pressure in CHN1 reaches its prescribed value (set point) and inflation of CHN1, ceases. A pause or delay interval then is commanded from between T1 to T2 where no further inflation activity is undertaken. At T2, inflation of CHN2 commences while CHN1 is maintained at its prescribed pressure set point. Once the pressure in CHN2 reaches its prescribed value, inflation of CHN2 ceases. Any variation of the pressure in CHN1, as shown at T3, resulting from the inflation of CHN2 is compensated by EC 26 so as to maintain CHN1 at its prescribed pressure set point. Subsequent to the delay interval between T3 and T4, inflation of CHN3 commences until the pressure in CHN3 reaches its prescribed value, while the pressures in CHN1 and CHN2 are maintained at their respective prescribed values. The above process continues in a like manner, including checking the chambers for any changes in their pressure vale due to pressurization of adjacent chambers, until all the chambers are inflated which terminates at time T6. At T6, the treatment termination criteria are examined and if none of the criteria are satisfied all chambers, except CHN1, are deflated between T6 and T7. The entire process, commencing with inflation of CHN2, is repeated. Upon completion of the entire repeated process, the termination criteria is again examined (at T9) and if any one of the criteria is satisfied, all the chambers, including CHN1 are deflated at T10, and the lymphedema treatment session is terminated.

At end of a lymphedema treatment session, all the operational parameters are logged into memory 32 so that the effectiveness of the therapies can be ascertained. Depending on the embodiment, certain acts, events, or functions of any of the methods described herein can be performed in a different sequence, may be added, merged, or elimnated (e.g., not all described acts or events are necessary for the practice of the method). Moreover, in certain embodiments, acts or events may be performed concurrently, e.g., through multi-threaded processing, interrupt processing, or multiple processors, rather than sequentially. The various illustrative logical blocks, modules, circuits, and algorithm steps described in connection with the embodiments disclosed herein may be implemented as electronic hardware, computer software, firmware or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall apparatus. The described functionality may be implemented in varying ways for each particular application, but such implementation decisions should not be interpreted as causing a departure from the scope and intent of the disclosure. The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein without departing from the spirit of the invention. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The lyphedema treatment method or algorithm described in connection with the embodiments disclosed herein may be embodied directly in hardware, in a software module executed by a processor, or in a combination thereof without departing from the spirit of the invention. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal. With regard to the use of a processor, the flow chart or algorithm disclosed at least in FIGS. 8*a*-8*e* provides more than adequate information for one skilled in the art to program such processor to perform the lymphedema treatment method disclosed herein.

While the above detailed description has shown, described, and pointed out novel features as applied to various embodiments, it will be understood that various omissions, substitutions, and changes in the form and details of the device or process illustrated may be made without departing from the spirit of the disclosure. As will be recognized, certain embodiments of the inventions described herein may be embodied within a form that does not provide all of the features and benefits set forth herein, as some features may be used or practiced separately from others. The scope of the inventions is indicated by the appended claims rather than by the foregoing description. All changes which come within the meaning and range of equivalency of the claims are to be embraced within their scope.

APPENDIX A

| | |
|---|---|
| KILL_PROFILE! | |
| PATIENT_FIRST=Emily | 112 |
| PATIENT_LAST=Iker | 112 |
| PATIENT_MID=Milka | 112 |
| PATIENT_REF=123-45-6789 | 113 |
| CFG_PROFILE=0 | 111 |
| PROFILE_NAME=LEG | 110 |
| STEP_ADDR[0]=0+8 | 102 + 106 |
| STEP_PRESS[0]=43 | 101 |
| STEP_END_DLY[0]=18 | 103 |
| STEP_ADDR[1]=1 | |
| STEP_PRESS[1]=44 | |
| STEP_END_DLY[1]=19 | |
| STEP_ADDR[2]=2 | |
| STEP_PRESS[2]=45 | |
| STEP_END_DLY[2]=20 | |
| STEP_ADDR[3]=3 | |
| STEP_PRESS[3]=46 | |
| STEP_END_DLY[3]=21 | |
| STEP_ADDR[4]=4 | |
| STEP_PRESS[4]=47 | |
| STEP_END_DLY[4]=22 | |
| STEP_ADDR[5]=5 | |
| STEP_PRESS[5]=48 | |
| STEP_END_DLY[5]=23 | |
| STEP_ADDR[6]=6 | |
| STEP_PRESS[6]=49 | |
| STEP_END_DLY[6]=24 | |
| STEP_ADDR[7]=7 | |
| STEP_PRESS[7]=50 | |
| STEP_END_DLY[7]=25 | |
| CUFF_PURGE_DLY=30 | |
| SEQ_NUM_CYC=10 | |
| SEQ_END_DLY=2 | |
| CUFF_NUM_STEPS=8 | |
| CFG_PROFILE=1 | |
| PROFILE_NAME=ARM | |
| STEP_ADDR[0]=0 | |
| STEP_PRESS[0]=40 | |
| STEP_END_DLY[0]=12 | |
| STEP_ADDR[1]=1 | |
| STEP_PRESS[1]=39 | |
| STEP_END_DLY[1]=12 | |
| STEP_ADDR[2]=2 | |
| STEP_PRESS[2]=38 | |
| STEP_END_DLY[2]=18 | |
| STEP_ADDR[3]=3 | |
| STEP_PRESS[3]=37 | |
| STEP_END_DLY[3]=18 | |
| STEP_ADDR[4]=4 | |
| STEP_PRESS[4]=36 | |
| STEP_END_DLY[4]=19 | |
| STEP_ADDR[5]=5 | |
| STEP_PRESS[5]=35 | |
| STEP_END_DLY[5]=19 | |
| STEP_ADDR[6]=6 | |
| STEP_PRESS[6]=34 | |
| STEP_END_DLY[6]=20 | |
| STEP_ADDR[7]=7 | |
| STEP_PRESS[7]=33 | |
| STEP_END_DLY[7]=20 | |
| CUFF_PURGE_DLY=30 | 115 |
| SEQ_NUM_CYC=10 | 104 |
| SEQ_END_DLY=2 | 105 |
| CUFF_NUM_STEPS=8 | 114 |
| IFT_AMPLITUDE=30 | 107 |
| PULSE_DURATION=5 | 108 |

-continued

APPENDIX A

| | |
|---|---|
| PULSE_FREQUENCY=11 | 109 |
| PROFILE_VALID=1 | |

What is claimed is:

1. A method of treating lymphedema using compression therapy comprising the steps of:

(a) positioning on a body extremity to be treated, a lymphedema treatment sleeve configured to fit around said body extremity, said body extremity having a proximal end and a distal end, the sleeve having a proximal end and a distal end, the proximal end of the sleeve being located at the distal end of the body extremity, the sleeve comprising a plurality of contiguous individually inflatable chambers sequentially arranged from the proximal end to the distal end of the sleeve;

(b) inflating the chamber at the proximal end of the sleeve to a respective prescribed chamber pressure to thereby commence compression therapy on said body extremity;

(c) subsequent to a predetermined time interval, inflating the next chamber in the sequence to a respective prescribed chamber pressure;

(d) repeating step (c) until all the chambers in the sequence are inflated; and (e) subsequent to a predetermined delay interval, deflating all the chambers except the proximal end chamber.

2. The method of claim 1 further comprising and beginning with inflating the chamber next to the proximal end chamber first, repeating steps (d) to (e) until a predetermined number of repetitions of step (e) has occurred and deflating all the chambers and terminating compression therapy thereafter.

3. The method of claim 1 further comprising and beginning with inflating the chamber next to the proximal end chamber first, repeating steps (d) to (e) until a predetermined time period has elapsed and deflating all the chambers and terminating compression therapy thereafter.

4. The method of claim 1 wherein the sleeve further comprises at least one pair of electrically conductive electrodes disposed on an inner surface of the sleeve, the at least one pair of electrically conductive electrodes configured to contact the skin of the body extremity around which the sleeve is positioned, said method further comprising the steps of:

(f) upon the completion of step (d), applying interrogation signals to the at least one pair of electrically conductive electrodes to undertake a quantitative biological impedance analysis of the body extremity as a measure of compression therapy effectiveness;

(g)starting with the chamber next to the proximal end chamber of the sleeve repeating steps (d) to (e) until the compression therapy effectiveness achieves a preset acceptable measure; and (h) deflating all the chambers and terminating compression therapy once the compression effectiveness therapy achieves the preset acceptable measure.

5. The method of claim 1, wherein the body extremity is characterized as having a biological impedance, further comprising, at the completion of step (a), the step of determining an initial value of the biological impedance of said body extremity.

6. The method of claim 1 further comprising the step of maintaining, during a respective predetermined time interval, the pressure in each inflated chamber at their respective prescribed value within a prescribed tolerance.

7. The method of claim 1 wherein the sleeve further comprises at least one pair of electrically conductive electrodes disposed on an inner surface of the sleeve, the at least one pair of electrically conductive electrodes configured to contact the skin of the body extremity around which the sleeve is positioned, said method further comprising the step of:

following step (a), commencing interferential therapy comprising applying electrical signals to the at least one pair of electrically conductive electrodes in accordance with a treatment protocol defining electrical signal amplitude, duration and frequency.

8. The method of claim 1 wherein step (c) further comprises the step of purging all of the uninflated chambers.

9. An lymphedema treatment apparatus comprising:

a lymphedema treatment sleeve configured to be positioned on and fit around a body extremity, said body extremity having a proximal end and a distal end, the sleeve having a proximal end and a distal end, the proximal end of the sleeve configured to be positioned at the distal end of the body extremity, the sleeve comprising a plurality of individually inflatable contiguous chambers sequentially arranged from the proximal end to the distal end of the sleeve;

a pump in fluid communication with the sleeve and adapted, upon command, to inflate each of the sleeve chambers to a respective prescribed pressure;

a deflation valve in fluid communication with the sleeve and adapted, upon command, to deflate selected chambers;

a processor arranged to execute a lymphedema treatment protocol for providing lymphedema therapy comprising the steps of:

(a) issuing commands to the pump to inflate the chamber at the proximal end of the sleeve to a respective prescribed chamber pressure to thereby commence compression therapy on said body extremity;

(b) subsequent to a predetermined time interval, issuing a command to the pump to inflate the next chamber in the sequence to a respective prescribed chamber pressure;

(c) repeating step (b) until all the chambers in the sequence are inflated; and (d) subsequent to a predetermined delay interval, issuing a command to the deflation valve to deflate all the chambers except the proximal end chamber.

10. The apparatus of claim 9 wherein the processor, beginning with inflating the chamber next to the proximal end chamber first, is arranged to issue commands to repeat steps (b) to (d) until a predetermined number of repetitions of step (d) has occurred and to issue a command to the deflation valve to deflate all the chambers and to terminate lymphedema therapy thereafter.

11. The apparatus of claim 9 wherein the processor, beginning with inflating the chamber next to the proximal end chamber first, is arranged to issue commands to repeat steps (b) to (d) until a predetermined time period has elapsed and to issue a command to the deflation valve to deflate all the chambers and terminate lymphedema therapy thereafter.

12. The apparatus of claim 9 further comprising a pressure sensor associated with each of the chambers to measure the pressure within each of the chambers wherein the processor is arranged to monitor the measured pressure in a chamber during a respective predetermined time interval and to maintain the pressure in each of the inflated chambers at their respective prescribed value within a prescribed tolerance.

13. The apparatus of claim 12 wherein the processor is arranged to monitor the pressure between a pressure sensor associated with a chamber and the corresponding chamber to thereby determine a pressure drop between the pressure sensor associated with a chamber and the corresponding chamber and to adjust the commands to the pump to compensate for any determined pressure drop.

14. The apparatus of claim 9 wherein the sleeve further comprises at least one pair of electrically conductive electrodes disposed on an inner surface of the sleeve, the at least one pair of electrically conductive electrodes configured to contact the skin of said body extremity around which the sleeve is positioned, said processor arranged to deliver interrogation signals to the at least one pair of electrically conductive electrodes to undertake a quantitative biological impedance analysis of the body extremity as a measure of lymphedema therapy effectiveness and starting with the chamber next to the proximal end chamber said processor is further arranged to issue commands to repeat steps (b) to (d) until the lymphedema therapy effectiveness achieves a preset acceptable measure and to command the deflation valve to deflate all the chambers and further to terminate lymphedema therapy once the lymphedema therapy effectiveness achieves the preset acceptable measure.

15. The apparatus of claim 9 wherein the sleeve further comprises at least one pair of electrically conductive electrodes disposed on an inner surface of the sleeve, the at least one pair of electrically conductive electrodes configured to contact the skin of said body extremity around which the sleeve is positioned, said processor further arranged to undertake interferential therapy comprising delivering electrical signals to the at least one pair of electrically conductive electrodes in accordance with a treatment protocol defining electrical signal amplitude, duration and frequency.

16. The apparatus of claim 9 further comprising an over pressure relief valve in communication with each of the chambers, said relief valve preventing the pressure in the respective chambers from exceeding a predetermined excessive value.

17. The apparatus of claim 9 wherein the processor is arranged to receive treatment protocols comprising programmable parameters utilized in undertaking lymphedema therapy.

18. The apparatus of claim 17 wherein the programmable parameters include defining respective chamber pressures when the chamber is inflated to provide for establishing either a monotonically decreasing, monotonically increasing or constant pressure gradient in the sleeve from the proximal end to the distal end of the sleeve.

19. The apparatus of claim 9 wherein the processor maintains the product of the respective prescribed chamber pressure and the predetermined time interval at a constant value.

20. A method of treating lymphedema using compression therapy comprising the steps of:

(a) positioning on a body extremity to be treated, a lymphedema treatment sleeve configured to fit around said body extremity, said body extremity having a proximal end and a distal end, the sleeve having a proximal end and a distal end, the proximal end of the sleeve being located at the distal end of the body extremity, the sleeve comprising a plurality of contiguous individually inflatable chambers sequentially arranged from the proximal end to the distal end of the sleeve;

(b) inflating the chamber at the proximal end of the sleeve to a respective prescribed chamber pressure within a prescribed tolerance value to thereby commence compression therapy on said body extremity;

(c) subsequent to a predetermined time interval, inflating the next chamber in the sequence to a respective prescribed chamber pressure within a prescribed tolerance value;

(d) monitoring the pressure in each one of the inflated chambers and adjusting the pressure in any of the monitored inflated chambers to its prescribed chamber pressure when its corresponding monitored chamber pressure falls outside the prescribed tolerance value;

(e) repeating steps (c) and (d) until all the chambers in the sequence are inflated; and (f) subsequent to a predetermined delay interval, deflating all the chambers except the proximal end chamber.

* * * * *